US011390440B2

(12) United States Patent
Gerrard et al.

(10) Patent No.: US 11,390,440 B2
(45) Date of Patent: Jul. 19, 2022

(54) PAPER-BASED MULTI-CARD PACKAGE

(71) Applicant: Incodia International Limited, Colchester (GB)

(72) Inventors: Paul Gerrard, Suffolk (GB); Scott Maxted, Lancashire (GB); Jennifer Chambers, Derbyshire (GB)

(73) Assignee: INCODIA INTERNATIONAL LIMITED, Colchester (GB)

( * ) Notice: Subject to any disclaimer, the term of this patent is extended or adjusted under 35 U.S.C. 154(b) by 0 days.

(21) Appl. No.: 16/961,380

(22) PCT Filed: Jan. 14, 2019

(86) PCT No.: PCT/GB2019/050086
§ 371 (c)(1),
(2) Date: Jul. 10, 2020

(87) PCT Pub. No.: WO2019/138248
PCT Pub. Date: Jul. 18, 2019

(65) Prior Publication Data

US 2021/0078782 A1 Mar. 18, 2021

Related U.S. Application Data

(60) Provisional application No. 62/617,024, filed on Jan. 12, 2018, provisional application No. 62/695,534, filed on Jul. 9, 2018.

(30) Foreign Application Priority Data

Feb. 16, 2018 (EP) ..... 18157233

(51) Int. Cl.
*B65D 73/00* (2006.01)
*B42D 15/04* (2006.01)

(52) U.S. Cl.
CPC ..... *B65D 73/0085* (2013.01); *B42D 15/045* (2013.01); *B65D 73/0021* (2013.01); *B65D 2203/06* (2013.01); *B65D 2571/0066* (2013.01)

(58) Field of Classification Search
CPC ..... B65D 73/0085; B65D 73/0021; B65D 2203/06; B65D 2571/0066; B42D 15/045; A45C 15/045; A45C 2011/186
(Continued)

(56) References Cited

U.S. PATENT DOCUMENTS 8,807,332 B1 8/2014 Pascua
2005/0017502 A1* 1/2005 Chariker ..... B42D 5/027 283/106
(Continued)

FOREIGN PATENT DOCUMENTS

EP 3 511 261 7/2019

OTHER PUBLICATIONS

Wimmer, Martin, International Search Report; dated Jun. 3, 2019; 6 pages, HV Rijswijk.
(Continued)

*Primary Examiner* — Luan K Bui
(74) *Attorney, Agent, or Firm* — Stetina Brunda Garred and Brucker

(57) ABSTRACT

An improved paper-based, multi-card package comprises a paper-based carrier and a plurality of cards each being paper-based and having machine-readable indicia indicative of a corresponding account. The cards may be provided as prepaid cards. The carrier may include a center panel, wherein the cards are positioned adjacent to a first side of the center panel. The carrier may further comprise a side flap adjoined to and folded over the center panel to define a seamless edge, and a side panel adjoined to the center panel and folded over and securely connected to portions of the
(Continued)

first side of the center panel and the folded side flap to define another seamless edge, wherein the cards are disposed in a secure, enclosed space within the carrier.

37 Claims, 13 Drawing Sheets

(58) Field of Classification Search
USPC ..... 206/39, 449, 461, 471, 806; 283/106; 235/486, 487, 492
See application file for complete search history.

(56) References Cited

U.S. PATENT DOCUMENTS

2007/0063021 A1 3/2007 Chakiris
2007/0063052 A1* 3/2007 Chakiris ..... B42D 15/045 235/486
2009/0091123 A1* 4/2009 Conley ..... B65D 75/5805 283/106
2009/0107862 A1* 4/2009 Pascua ..... B65D 75/20 206/232
2011/0137793 A1* 6/2011 Liggett ..... G06Q 20/105 705/41
2013/0186788 A1* 7/2013 Glass ..... B65D 73/0085 206/307
2017/0323191 A1* 11/2017 Pascua ..... G06K 19/06028
2018/0222241 A1* 8/2018 Moriarty ..... B42D 15/045

OTHER PUBLICATIONS

Faux, Paul, International Search Report; dated Jun. 3, 2019; 1 page, HV Rijswijk.
Wimmer, Martin, Written Opinion of International Search Report, dated Jun. 3, 2019; 9 pages, Munich.

* cited by examiner

PAPER-BASED MULTI-CARD PACKAGE

CROSS-REFERENCE TO RELATED APPLICATIONS

The present application claims priority to PCT International Patent Application No. PCT/GB2019/050086, filed Jan. 14, 2019, U.S. Provisional Patent Application No. 62/617,024, filed Jan. 12, 2018, European Patent Application No. 18157233.0 filed on Feb. 16, 2018, and U.S. Provisional Patent Application No. 62/695,534, filed Jul. 9, 2018, the disclosures of which are incorporated herein by reference.

STATEMENT RE: FEDERALLY SPONSORED RESEARCH/DEVELOPMENT

Not Applicable

BACKGROUND

The present invention relates to packaged card products, and more particularly, to card packages that include a plurality of cards having one or more associated accounts, and a carrier for containing the cards within a secure, enclosed space thereof.

The sale of prepaid plastic cards (e.g. plastic gift cards, telephone cards, etc.) and other plastic transaction cards at retail locations is widespread and geographically increasing. Typically, such plastic cards have account indicia indicative of corresponding accounts (e.g., machine-readable indicia), and in the case of prepaid cards, the corresponding accounts have predetermined values associated therewith. Often one or a plurality of such plastic cards are packaged, distributed and displayed at point-of-sale (POS) locations in an inactive state. In turn, in conjunction with a purchase transaction, the corresponding card(s) is activated at a POS location. Typically, activation entails reading machine-readable activation indicia on the card packaging therefor, correlating the read data with one or more card account(s) that corresponds with the card(s), and activating the account(s)/card(s) for use.

Unfortunately, third-party tampering with plastic card packaging at POS locations has presented continuing design challenges. For example, third-parties may wrongfully access the cards to obtain proprietary account data at a POS location, which proprietary account data may then be fraudulently employed after purchase and activation of the cards to access account funds corresponding with the cards. As a result of such tampering schemes, various secure packaging approaches have been proposed to reduce incidents of tampering.

However, with the implementation of secure packaging approaches, the usage of packaged plastic card products has continued to increase, thereby resulting in significant plastic waste. In turn, such waste contributes to the ever-increasing concerns associated with the environmental impact of plastic products. For example up to 80% of ocean plastic pollution enters the ocean from land, resulting in the death of thousands of sea mammals and birds. And, more generally, plastic waste results in the accumulation and release of dangerous toxins in landfills and other areas of accumulation.

Further, plastic waste associated with packaged plastic card products typically constitutes single use plastic. Recently, single use plastic products have received increased scrutiny from environmentalists and governmental authorities. For example, in an effort to discourage the proliferation of plastic bag usage, some authorities have instituted regulations requiring retailers to impose a customer charge for the use of plastic bags. Additionally, in some areas, a total ban on the use of certain types of single use plastic products is under consideration. Unfortunately, despite such efforts, the use and disposal of single use plastic products continues to increase.

BRIEF SUMMARY

In one embodiment, an improved multi-card package may comprise a plurality of cards, each being paper-based and having indicia indicative of an account associated therewith, and a paper-based carrier. The paper-based carrier may include a center panel, a side flap adjoined to the center panel along a first adjoinment line, and a side panel adjoined to the center panel along a second adjoinment line. The side flap may be folded over at least a portion of a first side of the center panel to define a seamless edge. Further, the side panel may be folded over and securely connected to opposing first and second edge portions of the first side of the center panel and a side edge portion of the folded side flap to define another seamless edge and a secure, enclosed space within which the plurality of cards are disposed.

As indicated, the plurality of cards and carrier may comprise paper-based materials. In that regard, the carrier and cards may each comprise at least about 90%, and preferably at least about 95% percent, by weight organic and otherwise biodegradable materials (e.g. cellulose materials such as plant-based cellulose). Correspondingly, the multi-card package may comprise substantially no non-biodegradable polymer-based materials (e.g. less than about 5% or even 2% by weight), and may otherwise comprise at least about 90%, and preferably at least about 95% percent, by weight organic and otherwise biodegradable materials (e.g. cellulose materials such as plant-based cellulose). In turn, the multi-card package provides an eco-friendly card product, while also offering superior anti-fraud advantages.

In some embodiments, the side flap may be folded over at least a portion of and releasably attached to at least one of the plurality of cards. In one approach, the side flap may be folded over at least a portion of each of the plurality of cards.

In some arrangements, adjacent ones of the plurality of cards may be disposed in partially overlapping relation. In such arrangements, the side flap may be releasably attached to at least one of the plurality of cards by a peelable glue region disposed on at least one of the plurality of cards.

In contemplated embodiments, at least a bottom card of the plurality of cards may be releasably attached to the first side of the center panel. In turn, overlapping portions of adjacent ones of the plurality of cards may be releasably attached to one another. For example, the bottom card may be releasably attached to the first side of the center panel by at least one peelable glue region disposed on a first side of the panel, and overlapping portions of adjacent ones of the plurality of cards may be releasably attached by corresponding additional, peelable glue regions disposed on an overlapped portion of a corresponding one of the plurality of cards. In contemplated implementations, the side panel may be folded over and securely connected to the first and second edge portions of the first side of the center panel and to the side edge portion of the folded side flap by a non-releasable glue. More particularly, such non-releasable connection may be established by plurality of non-releasable glue regions located along each of the first and second edge portions of the first side of the side of the center panel, and by continuous non-releasable glue line disposed on the side edge portion of the folded side flap.

In some embodiments, the center panel may further comprise an aperture, wherein a bottom one of the plurality of cards may be located in a predetermined position so that account associable indicia (i.e. indicia associable with one or more account(s) corresponding with the plurality of cards) disposed on a downward-facing, or back, side of the bottom card is viewable through the aperture. In that regard, the plurality of cards may be releasably attached so that the account associable indicia provided on the back side of the bottom card is viewable through the aperture from a second side of the center panel. By way of example, the account associable indicia may comprise a series of human-readable characters that may be associated with one or more account(s) corresponding with the plurality of cards.

In contemplated implementations the center panel and/or side panel may further comprise a separable portion, wherein after assembly of the multi-card package the separable portion is manipulable to define an opening to access the secure, enclosed space for removal of the plurality of cards therethrough. In that regard, the separable portion may extend inwardly from an edge comprising one of the opposing first and second edge portions of the center panel and/or from an edge comprising one of opposing first and second edge portions of the side panel toward an edge comprising the other one of the opposing first and second edge portions of the center panel and/or side panel.

In some arrangements, the separable portion may comprise a tear strip defined by at least one of the following:

a plurality of pairs of spaced slits that successively extend across the center panel, including a first pair of spaced slits that define a graspable pull tab at an edge of one of said top and bottom edge portions of the center panel, wherein the pull tab may be manipulated to progressively define an opening across the center panel between and along the remaining pairs of spaced slits; and, a tear string that extends across the center panel and includes a graspable end located at an edge of one of the first and second side edge portions of the center panel, wherein the tear string may be manipulated to progressively define an opening across the center panel along the tear string. In other arrangements, the separable portion may be defined by one or a spaced pair of perforation line(s) that extend across the center panel, wherein the perforation line(s) may be manipulated to progressively define an opening across the center panel along the perforation line(s). In some embodiments, a separable portion may extend from an edge of one of said first and second edge portions of the center panel to an end location that is overlapped by at least one of the plurality cards. In that regard, the separable portion may be overlapped by each of the plurality of cards.

In other implementations, the center panel and/or side panel may comprise a separable portion, wherein after assembly of the multi-card package the separable portion is manipulatable to define an opening along an edge of the first side edge portion of the center panel and/or a first side edge portion of the side panel to access the enclosed space for removal of cards therethrough. In one approach, commonly configured separable portions may be provided in the center panel and the side panel, wherein such separable portions are located in overlapping, coincidental, face-to-face relation in the assembled multi-card package to accommodate co-manipulation and removal of the separable portions together, as will be further described. The separable portion of the center panel and/or of side panel may include all or at least a portion of a corresponding aperture employable for hanging the multi-card package over a hook at a point of sale location. In some embodiments, separable portions of the center panel and side panel extend about the entirety of corresponding apertures that are aligned upon assembly of the multi-card package. As may be appreciated, in the event of undesired tampering with the separable portion of the center panel and/or side panel, the corresponding aperture(s) may be visibly and/or functionally damaged, thereby advantageously impeding suspension of the multi-card package on a support hook and/or otherwise facilitating detection of such tampering before sale by service personnel at a point of sale location.

In some arrangements, a separable portion of the center panel may extend inward from an edge of the first side edge portion thereof. Similarly, a corresponding separable portion of the side panel may extend from an edge of a first side edge portion of the side panel. Each of the separable portions may be defined by a corresponding plurality of perforations that successively extend from a first end located at the edge of the corresponding first side edge portion to a second end, located at the same edge of the corresponding first side edge portion, in spaced relation to the first end thereof. Optionally, each plurality of perforations may define a plurality of corresponding linear portions to facilitate manufacture and operability (e.g. at least three linear portions). In one approach, adjacent ones of the linear portions may define an included angle therebetween of at least about 90 degrees to further facilitate separation of the separable portions. Further, the linear portions at each end of each plurality of perforations may extend inward substantially perpendicular from the edge of the corresponding first side edge portion.

In contemplated arrangements, the carrier may be a first rectangular configuration having a corresponding first length greater than a corresponding first width, and each of the plurality of cards may be of a second rectangular configuration having a corresponding second length greater than a corresponding second width, wherein the first width is greater than each of the second length and second width. In turn, the plurality of cards may be disposed lengthwise across a portion of the first width of the carrier with the secure, enclosed space.

In conjunction with such arrangements, the first and second edge portions of the first side of the center panel may extend along the top and bottom edge portions of the carrier, respectively. In turn, the side edge portion of the folded side flap may extend along the first side of the center panel between the first and second edge portions thereof. In contemplated arrangements, the folded side flap may overlap at least about 25% and no more than about 45% of the first width of the center panel, and preferably between about 29% to 40% of the first width of the center panel. Further, in some arrangements, the folded side flap may over lap at least about 25% and no more than about 40% of the second width of each of the plurality of cards, and preferably between about 26% to 38% of the second width of each of the plurality of cards.

In various embodiments, a multi-card package may be provided in which the carrier is of a single piece construction and comprises a first paperboard type having a first thickness, the plurality of cards each comprise a second paperboard type having a second thickness, and wherein the second thickness is at least about 50%, and preferably at least about 75% greater than the first thickness. In that regard, multiple design opportunities are presented for the implementation of a robust, secure and eco-friendly multi-card package.

Numerous additional features and advantages of the present invention will become apparent to those skilled in the art upon consideration of the embodiment descriptions provided hereinbelow.

DETAILED DESCRIPTION

Figure 1:
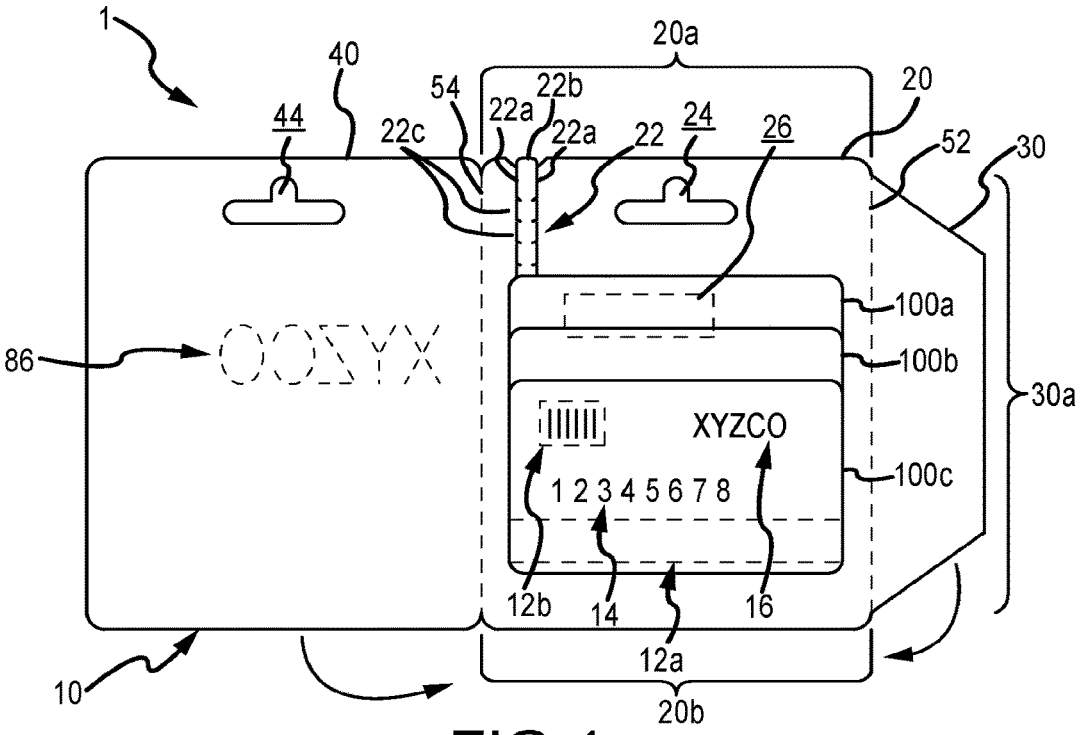
FIG. 1 illustrates one embodiment of a paper-based, multi-card package.

FIG. 1 illustrates an embodiment of a multi-card package 1 comprising a carrier 10 and a plurality of cards 100*a*, 100*b*, 100*c* (e.g. prepaid cards such as gift cards) disposed for containment within a secure, enclosed space defined by the carrier 10. In the later regard, the carrier 10 may comprise a center panel 20, a side flap 30 foldable over a first, or inner, side of the center panel 20 to define a seamless side edge, and a side panel 40 foldable over and non-releasably securable to opposing first and second edge portions 20*a*, 20*b* of center panel 20 and to a side edge portion 30*a* of side flap 30 to define another seamless edge and the enclosed space in the finished product, as will be further described.

In contemplated embodiments, the multi-card package 1 may comprise paper-based materials. In that regard, the carrier 10 and cards 100*a*, 100*b*, 100*c* may each comprise at least about 90%, and preferably at least about 95%, by weight organic or otherwise biodegradable materials (e.g. cellulose material such as plant-based cellulose). Correspondingly, the multi-card package 1 comprises substantially no non-biodegradable polymer-based materials (e.g. less than about 5% or even 2% by weight), and otherwise comprises at least about 90%, and preferably at least about 95%, by weight organic or otherwise biodegradable materials (e.g. cellulose material such as plant-based cellulose). In turn, the multi-card package 1 provides an eco-friendly card product, while also offering superior anti-fraud advantages.

More particularly, and as illustrated in FIG. 1, carrier 10 may be of single-piece construction, wherein the center panel 20, side flap 30 and side panel 40 may be defined by a common, continuous substrate, or sheet, of a paper-based material. In turn, side flap 30 may be adjoined to center panel 20 along a first adjoinment line 52 on a first side of the center panel 20, and side panel 40 may be adjoined to center panel 20 along a second adjoinment line 54 along a second side of the center panel 20 opposite to the first side thereof. The first and second adjoinment lines 52, 54 may define corresponding fold lines, wherein the first and second adjoinment lines 52, 54, may advantageously define opposing, secure side edges of multi-card package 1. As will be further described, upon folding side flap 30 over center panel 20 along first adjoinment line 52, and folding side panel 40 over center panel 20, corresponding seamless side edges may be provided by corresponding continuous lengths of the substrate comprising carrier 10 (e.g. as opposed to side edges having opposing panel edges adhered or otherwise adjoined along exposed seam lines), thereby yielding enhanced anti-fraud advantages, as well as advantageously facilitating the realization of a reduced width profile of a finished product (e.g. due to the elimination of side edges having opposing panel edge regions adhered or otherwise adjoined along an exposed seam line).

In the illustrated embodiment, side flap 30 extends between the first and second edge portions 20*a*, 20*b*, along first adjoinment line 52. Similarly, side panel 40 extends from first edge portion 20*a* to second edge portion 20*b* along second adjoinment line 54. In one approach, the first and second adjoinment lines 52, 54 may be defined by corresponding perforations, or depressions, in the carrier 10, thereby facilitating the folding of side flap 30 over the center panel 20 and folding of side panel 40 over the center panel 20 and folded side flap 30.

As shown in FIG. 1, the plurality of cards 100*a*, 100*b*, 100*c* may be disposed adjacent to the first side of center panel 20 of carrier 10 in partially overlapping relation. The cards 100*a*, 100*b*, 100*c* may be of a common rectangular configuration with a length that exceeds a width. In particular, the cards 100*a*, 100*b*, 100*c* may be sized as CR80 cards. In some arrangements, the plurality of cards 100*a*, 100*b*, 100*c*, may comprise three cards as illustrated. In other arrangements, one, two or four or more cards may be provided. In any case, the side flap 30 may be folded over and releasably attached to at least one of the cards 100*a*, 100*b*, 100*c*, as will be further described.

In contemplated arrangements, the folded side flap 30 may overlap at least about 25% and no more than about 45% of a width of the center panel 20, and preferably between about 29% to 40% of the width of the center panel 20. Further, in some arrangements, the folded side flap 30 may overlap at least about 25% and no more than about 40% of a width of each of the plurality of cards 100*a*, 100*b*, 100*c*, and preferably between about 26% to 38% of the width of each of the plurality of cards 100*a*, 100*b*, 100*c*. In contemplated embodiments, carrier 10 may comprise a first paperboard type having a first thickness, and the plurality of cards 100*a*, 100*b*, 100*c* may each comprise a second paperboard type having a second thickness, wherein the second thickness is at least about 50%, and preferably at least about 75%, greater than the first thickness. In some arrangements, the first paperboard type may have a first thickness within a range of about 290 micron to about 360 micron, and the second paperboard type may have a second thickness within a range of about 500 micron to about 800 micron. In one specific example, the first paperboard type may have a weight/thickness of about 260 grams per square meter/345 micron, and the second paperboard type may have weight/thickness of about 440 grams per square meter/610 micron. In some embodiments, one or both sides of the carrier 10 (e.g. at least the downward-facing, or back/outer, side thereof) and/or one or both sides of the plurality of cards 100*a*, 100*b*, 100*c* may have a coating applied thereto.

With further reference to FIG. 1, center panel 20 of carrier 10 may comprise a separable portion 22 manipulatable to define an opening through the center panel 20 to access the enclosed space for removal of cards 100 therethrough. As shown, the separable portion 22 may extend from an edge of the first side edge portion 20*a* of center panel 20 toward the second side edge portion 20*b* thereof. In the illustrated embodiment, separable portion 22 may comprise a pair of adjacent slit lines 22*a*, or perforations, defining a graspable pull tab 22*b* located at the edge of the first side edge portion 20*a*, and an additional plurality of spaced pairs of adjacent slits 22*c* successively extending across a portion of the center panel 20 toward the second edge portion 20*b*, as will be further described.

As further shown in FIG. 1, carrier 10 may further comprise a hangar aperture defined by an aperture 24 through center panel 20 and an aperture 44 through side panel 40. Apertures 24 and 44 may be of a coincidental configuration, wherein aperture 24 is larger than said aperture 44 about the peripheries thereof. As may be appreciated, aperture 44 may overlie aperture 24 to define the hangar aperture for suspending multi-card package 1 on support hook at a point of sale location.

With further reference to FIG. 1, center panel 20 may also include an aperture 26 (shown in phantom lines) located so that a bottom one of the plurality of cards 100*a*, 100*b*, 100*c* overlaps the aperture 26. In turn, the bottom card 100*a* may be provided with account associable indicia on a downward-facing, or back, side thereof that is located in a fixed location relative to and viewable through the aperture 26 from a second, or outer, side of the center panel 20, i.e. viewable before the multi-card package is accessed for removal of the cards 100*a*, 100*b*, 100*c*, as will be further described.

As shown by exemplary card 100*c* in FIG. 1, the plurality of cards 100*a*, 100*b*, 100*c* may each include machine-readable account indicia indicative of an account corresponding with the given card and employable in transactional use of the card, e.g. in the form of an encoded magnetic stripe 12*a* (shown in phantom lines) and/or bar code 12*b* (shown in phantom lines) disposed on a downward-facing, or back, side of the card and/or on an upward-facing, or front, side of the card. Further, human-readable account indicia 14 may be provided on each of the cards 100*a*, 100*b*, 100*c*, e.g. printed and/or embossed human-readable characters on the front and/or back sides thereof. Additionally, printing 16 may be provided on the front and/or back sides of the cards 100*a*, 100*b*, 100*c*, and may comprise a name/brand/logo of a goods/services merchant and/or issuer/processor associated with the cards 100*a*, 100*b*, 100*c*, and/or graphics selected thereby. In varying instances, cards 100*a*, 100*b*, 100*c* may comprise prepaid cards for the same merchant or for different merchants. Additionally, cards 100*a*, 110*b*, 100*c* may have corresponding activatable accounts having the same prepaid value or different prepaid values. Further, cards 100*a*, 100*b*, 100*c* may be provided with additional card features, e.g. signature blocks, and scratch-off panel regions with underlying PINs (i.e. personal identification numbers for the corresponding card account).

With further reference to FIG. 1, printing 86 may be provided on outer-facing sides of the side panel 40 and/or center panel 20, and may comprise instructions for card activation, fraud detection inspection and/or accessing the cards 100*a*, 100*b*, 100*c*, and/or a name/brand/logo of a goods/services merchant and/or issuer/processor associated with the cards 100*a*, 100*b*, 100*c*, and/or graphics selected thereby.

Figure 2:
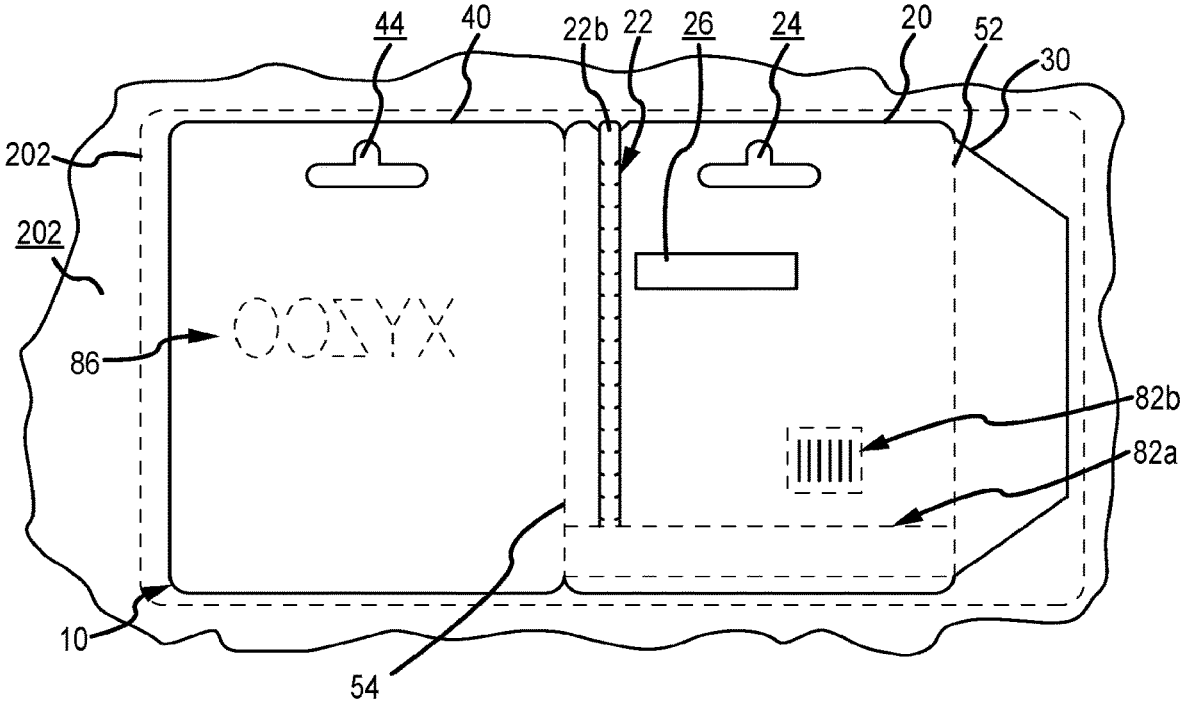
FIG. 2 illustrates a carrier of the embodiment of FIG. 1.

Reference is now made to FIGS. 2-12 which illustrate additional features of the multi-card package 1 and a method embodiment for the manufacture thereof. As shown in FIG. 2, an outer-facing, second side of the center panel 20 may be provided with machine-readable activation indicia corresponding with the plurality of cards 100*a*, 100*b*, and 100*c* and readable to activate the accounts associated with each of the cards 100*a*, 100*b*, and 100*c*. For example, the machine-readable activation indicia may comprise an encoded magnetic stripe 82*a* (shown in phantom lines) and/or bar code 82*b* (shown in phantom lines) that may be read at a POS location to effect activation of all of the accounts corresponding with cards 100*a*, 100*b*, 100*c*.

As further illustrated in FIG. 2, a single piece carrier 10 may be provided for separation from a paperboard sheet 200 via an automated operation (e.g. via an automated die cut or punch operation) to include the interconnected center panel 20, side flap 30 and side panel 40, as described above. Prior to or after such separation, the first and second adjoinment lines 52, 54 may be defined by an automated operation (e.g. an automated perforation operation), separable portion 22 may be defined by an automated operation (e.g. an automated slit formation operation), apertures 24, 44 and 26 may be defined by an automated operation (e.g. via an automated die cut or punch operation), printing 86 may be defined on one or both sides of carrier 10 by an automated operation (e.g. via one or more of an automated silk-screening, lithographic, Gauvre roll, ink-jet and/or other printing operation), and machine readable activation indicia 82*a*, 82*b* may be provided by an automated operation (e.g. via an automated operation in which a back surface of magnetic stripe 82*a* is adhered to the carrier 10 and thereafter encoded and/or in which bar code 82*b* is printed on the carrier 10).

In one approach, a plurality of carriers 10 may be separated from different corresponding regions 202 of the paperboard sheet 200 in an automated operation, and prior to such separation, one or more of the additional automated operations noted above may be completed in relation to each of the corresponding regions 202 of the paperboard sheet 200. For example, the plurality of regions 202 may be arranged in rows and columns across the paperboard sheet 200, wherein corresponding carriers 10 and described features thereof are commonly oriented in each of the plurality of regions 202.

In conjunction with such approach, a length of magnetic tape may be adhered to paperboard sheet 200 to extend across a number of regions 202 to define the magnetic stripe 82*a* of a corresponding number of carriers 10 thereafter separated from the paperboard sheet 200. In turn, after separation of a given carrier 10 from paperboard sheet 200, the corresponding magnetic stripe 82*a* may be encoded with activation data associable with the accounts corresponding with cards 100*a*, 100*b*, 100*c* to be provided therewith, typically prior to positioning of the cards 100*a*, 100*b*, 100*c* relative to carrier 10. Relatedly, if a bar code 82*b* is employed it is normally printed on a given carrier 10 after separation from paperboard sheet 200 to provide activation data associable with the accounts corresponding with cards 100*a*, 100*b*, 100*c* to be provided therewith, typically prior to positioning of the cards 100*a*, 100*b*, 100*c* relative to carrier 10.

Similarly, cards 100*a*, 100*b*, 100*c*, and additional cards thereto, may be separated, or singulated, from another paperboard sheet in an automated operation. In that regard, a length of magnetic tape may be adhered to the paperboard sheet to extend across a number of regions to define the magnetic stripe 12*a* of a corresponding number of cards thereafter separated from the paperboard sheet. In turn, after separation of cards 100*a*, 100*b*, 100*c* from the paperboard sheet, the corresponding magnetic stripes 12*a* may be encoded with corresponding account-specific data prior to positioning of the cards 100*a*, 100*b*, 100*c* relative to carrier 10. Relatedly, if bar codes 12*b* are employed on cards 100*a*, 100*b*, 100*c*, a bar code 12*b* may be printed on each given card after separation from the paperboard sheet to provide corresponding account-specific data corresponding with the card, typically prior to positioning of cards 100*a*, 100*b*, 100*c* relative to carrier 10.

Figure 3:
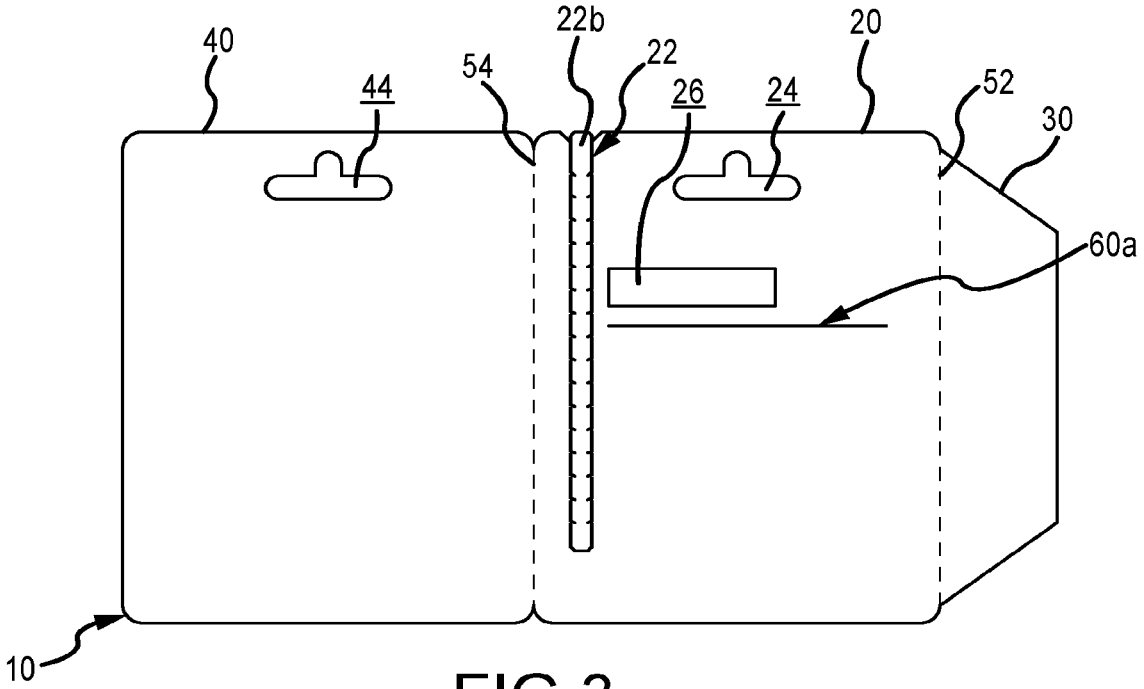
FIGS. 3-8 illustrate the carrier of the embodiment of FIG. 1, and the successive disposition of glue regions and releasable attachment of cards of the embodiment of FIG. 1.

Reference is now made to FIGS. 3-8 which illustrate steps for sequential attachment of cards 100*a*, 100*b* and 100*c*. As shown in FIG. 3, a first peelable glue region 60*a* (e.g. a glue line) may be disposed on the first side of center panel 20 to one side of separable portion 22 and below aperture 26. In the illustrated embodiment, the first peelable glue region 60*a* may extend in a direction substantially normal to the first and second adjoinment lines 52, 54.

Figure 4:
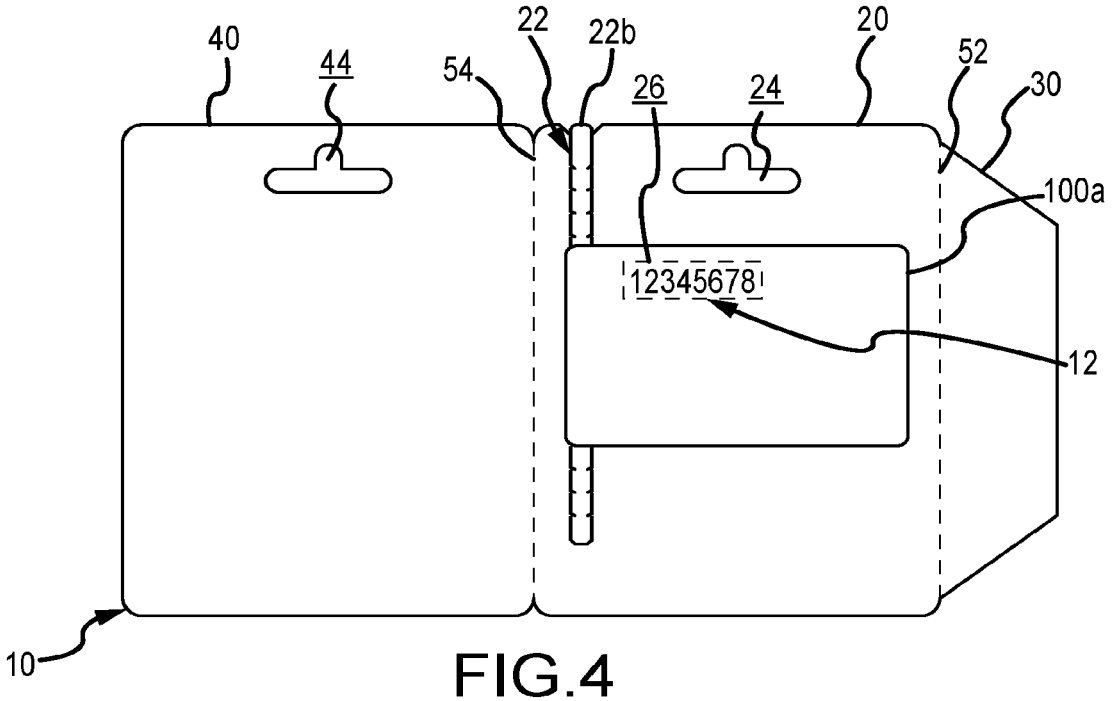

FIG. 4 illustrates releasable attachment of card 100*a* to the first side of center panel 20 via the first peelable glue region 60*a*. As shown in phantom lines, card 100*a* may be attached so that account indicia 12 disposed on the down-facing, or back, side of card 100*a* is visible through the aperture 26 from a second side of the center panel 20.

Figure 5:
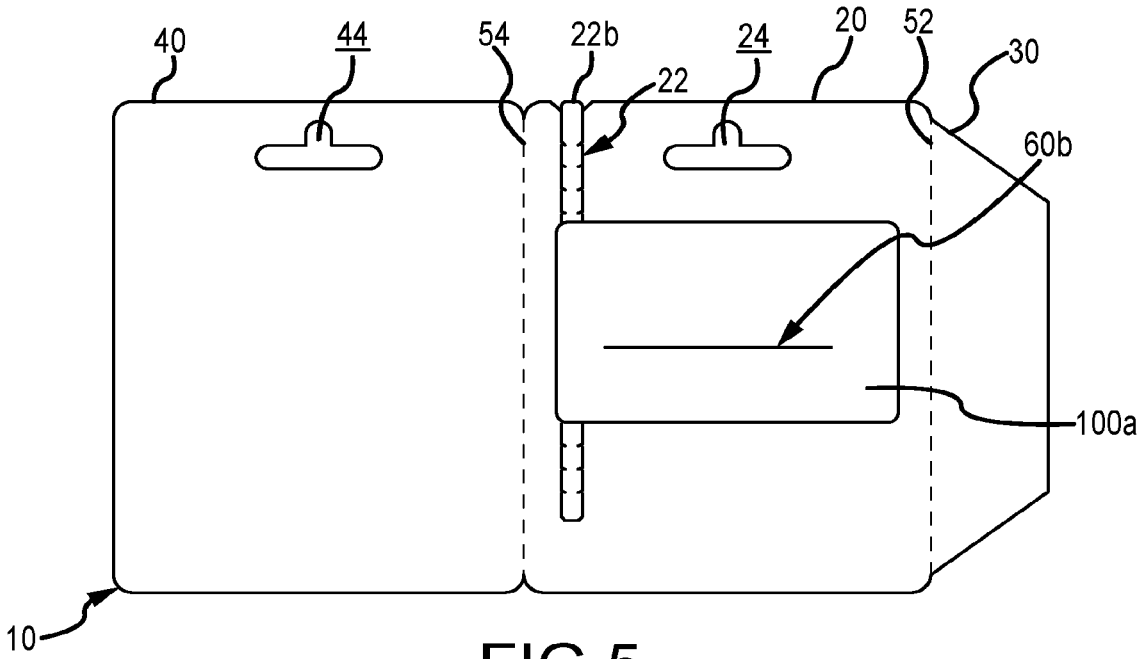

As shown in FIG. 5, a second peelable glue region 60*b* (e.g. a glue line) may be disposed on the upward-facing, or front, side of card 100*a*. The second peelable glue region 60*b* may be of the same configuration as, and located in parallel relation to, the first peelable glue region 60*a*, thereby facilitating automated operations for disposing the first and second peelable glue regions 60*a*, 60*b*. In turn, in the illustrated embodiment, the second peelable glue region 60*b* may also extend in a direction substantially normal to the first and second adjoinment lines 52, 54.

Figure 6:
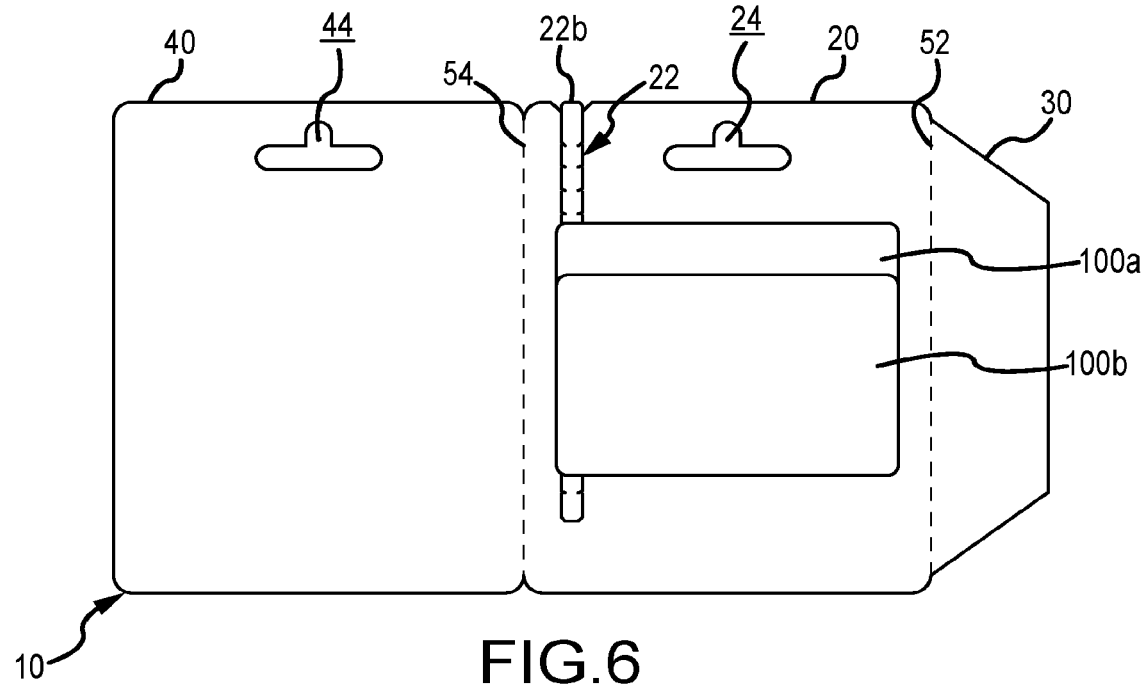

FIG. 6 illustrates releasable attachment of card 100*b* to the upward-facing, or front, side of card 100*a* via the second peelable glue region 60*b*. As shown, card 100*b* may partially overlap card 100*a* with the second peelable glue region 60*b* disposed between the overlapping portions of cards 100*a* and 100*b*.

Figure 7:
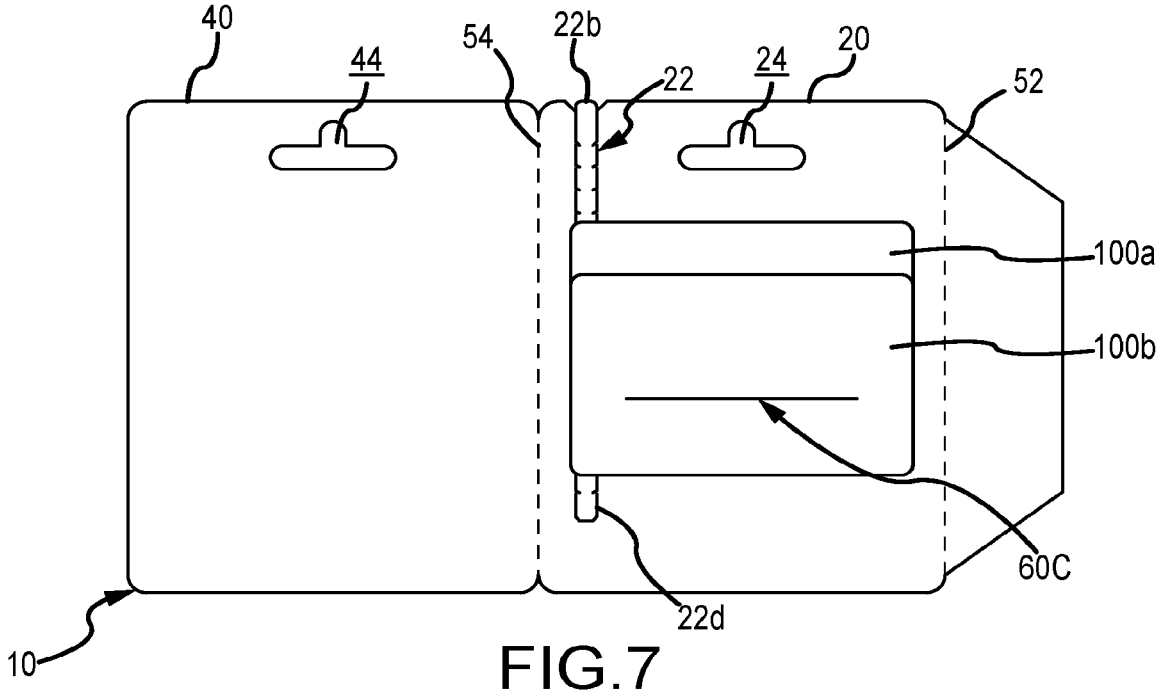

As shown in FIG. 7, a third peelable glue region 60*c* (e.g. a glue line) may be disposed on the upward-facing, or front, side of card 100*b*. The third peelable glue region 60*b* may be of the same configuration as, and located parallel relation to, the first peelable glue region 60*a* and second peelable glue region 60*b*, thereby facilitating automated operations for disposing the first, second and third peelable glue regions 60*a*, 60*b* 60*c*. In turn, in the illustrated embodiment, the third peelable glue region 60*c* may also extend in a direction substantially normal to the first and second adjoinment lines 52, 54.

Figure 8:
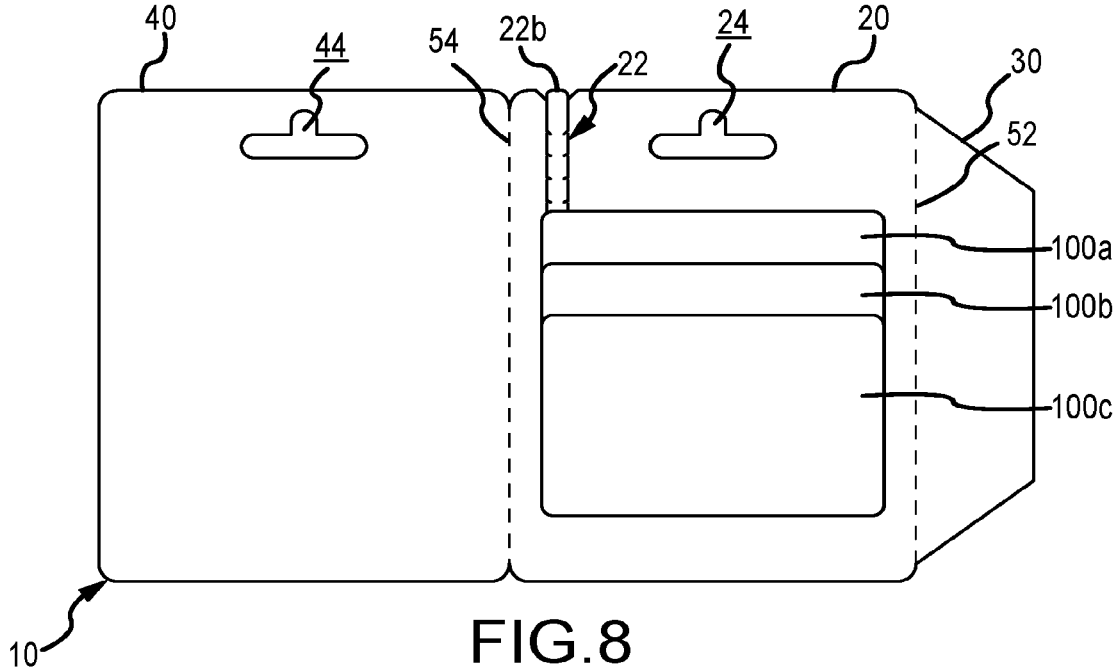

FIG. 8 illustrates releasable attachment of card 100*c* to the upward-facing, or front, side of card 100*b* via the third peelable glue region 60*c*. As shown, card 100*c* may partially overlap card 100*b* with the third peelable glue region 60*c* disposed between the overlapping portions of cards 100*b* and 100*c*. Further, each of the cards 100*a*, 100*b*, and 100*c* may partially overlap, or extend over, the separable portion 22, with side edges of each of the cards 100*a*, 100*b*, and 100*c* aligned with and slightly offset from the separable portion 22. In the later regard, a bottom end 22*c* of the separable portion 22 may extend beyond card 100*b*, as shown by FIG. 7, and may be overlapped by card 100*c*, as shown in FIG. 8.

Figure 9:
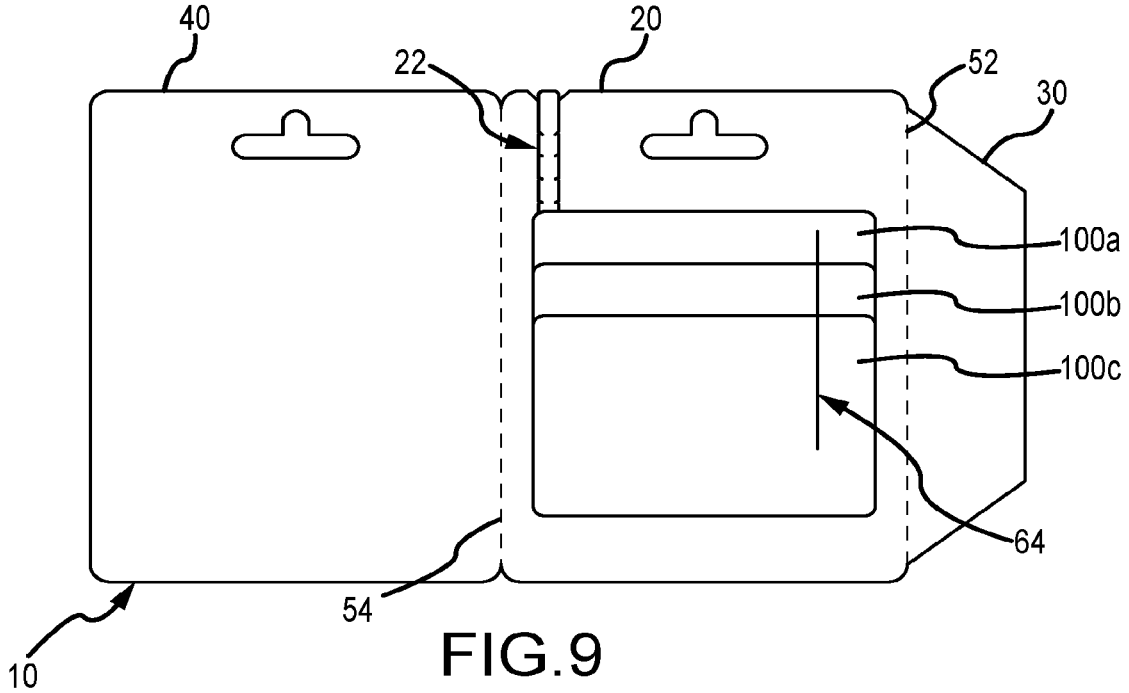
FIG. 9 illustrates the carrier of the embodiment of FIG. 1, and the disposition of at least one additional glue region to at least one of the cards of the embodiment of FIG. 1.

Reference is now made to FIGS. 9-12 which illustrate fold-over positioning of and releasable attachment of side flap 30 relative to cards 100*a*, 100*b*, 100*c*, and non-releasable attachment of side panel 40 to center panel 20 and folded side flap 30. As shown in FIG. 9, a fourth peelable glue region 64 in the form of a continuous glue line may be disposed on the top sides of overlapping cards 100*a*, 100*b*, 100*c*, wherein the fourth peelable glue region 64 extends over the edge of card 100*b* overlapping card 100*a* and over the edge of card 100*c* overlapping card 100*b*. Again, fourth peelable glue region 64 may be disposed in an automated manner. In the illustrated embodiment, the fourth peelable glue region 64 extends substantially parallel to first and second adjoinment lines 52, 54, and is located a distance from first adjoinment line 52 that is less than a width of a portion of the side flap 30 to be folded over the center panel 20.

Figure 10:
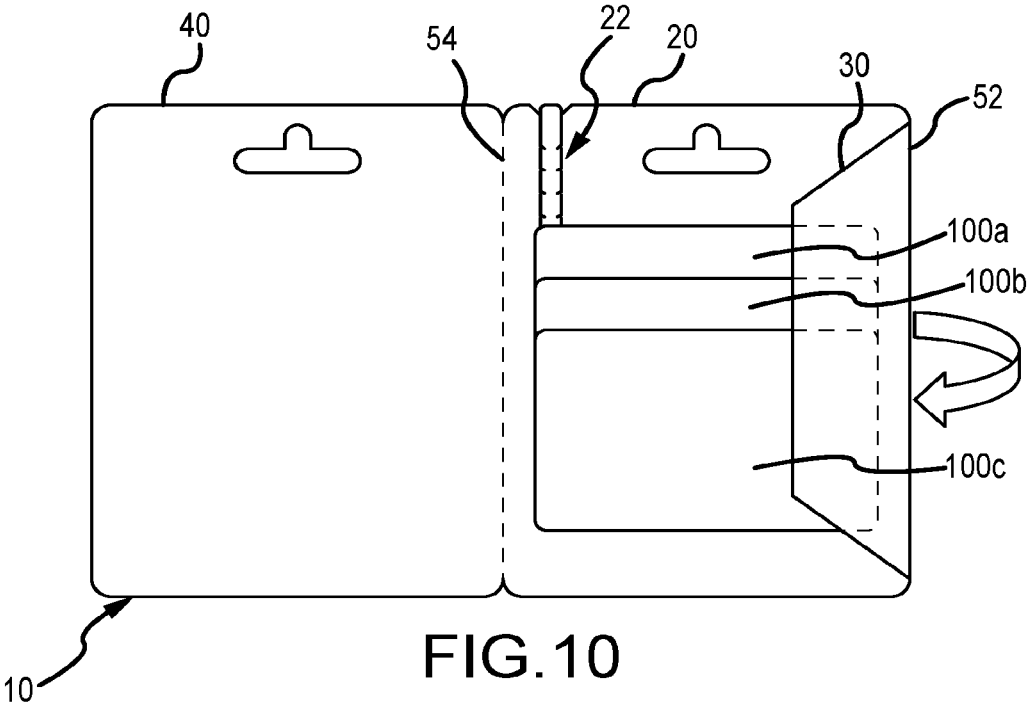
FIG. 10 illustrates a side flap of the carrier of the embodiment of FIG. 1, as folded over a center panel thereof and releasably attached to the glue region shown in FIG. 9.

More particularly, and as shown in FIG. 10, side flap 30 may be folded along first adjoinment line 52, over portions of center panel 20 and cards 100*a*, 100*b*, 100*c*, and releasably attached to cards 100*a*, 100*b*, 100*c* via the fourth peelable glue region 64. As may be appreciated, the fold at first adjoinment line 52 defines a secure, seamless side edge of the multi-card package 1.

Figure 11:
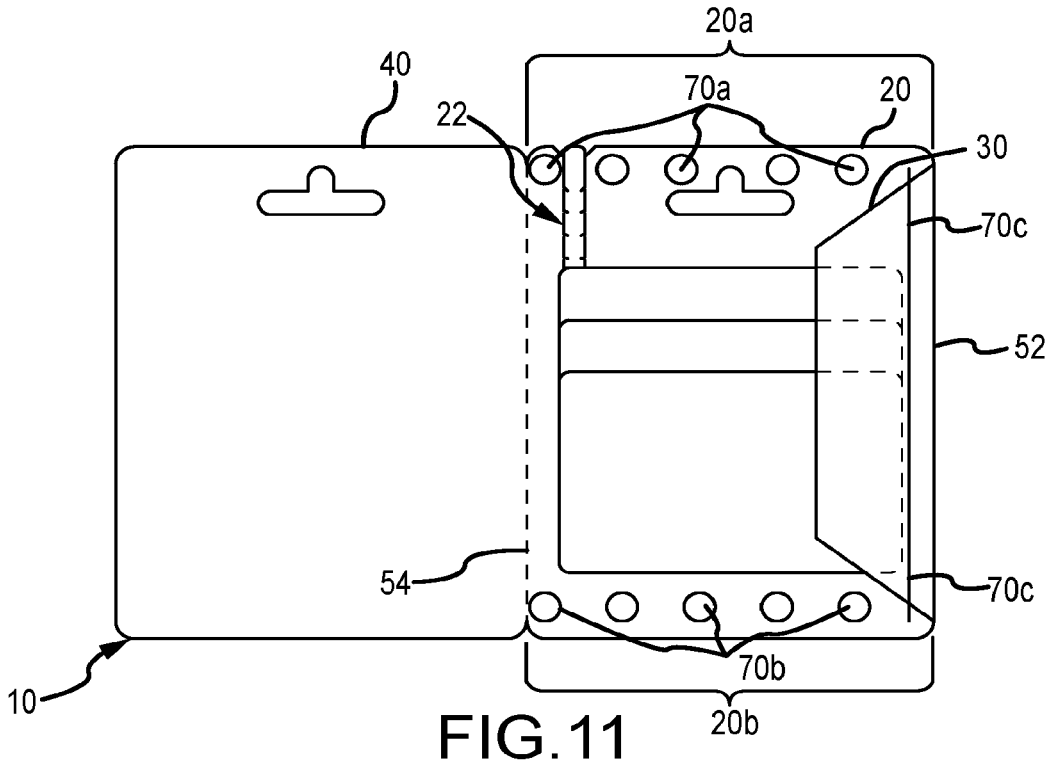
FIG. 11 illustrates the disposition of glue regions on the center panel and folded side flap of the carrier of the embodiment of FIG. 1, as shown in FIG. 10.

In turn, and as illustrated in FIG. 11, non-releasable glue regions 70*a*, 70*b* and 70*c* may be disposed on center panel 20 and folded side flap 30. More particularly, a plurality of non-releasable glue regions 70*a* may disposed on the first side of center panel 20 along the first side edge portion 20*a*, a plurality of non-releasable glue regions 70*b* may be disposed on the first side of center panel 20 along the second side edge portion 20*b*, and a non-releasable glue region 70*c* in the form of a continuous glue line may be disposed on the folded side flap 30 parallel to the first adjoinment line 52 and having end portions that extend over adjacent portions of center panel 20 on the first side thereof. Again, the non-releasable glue regions 70*a*, 70*b*, 70*c* may be disposed in automated operations.

Figure 12:
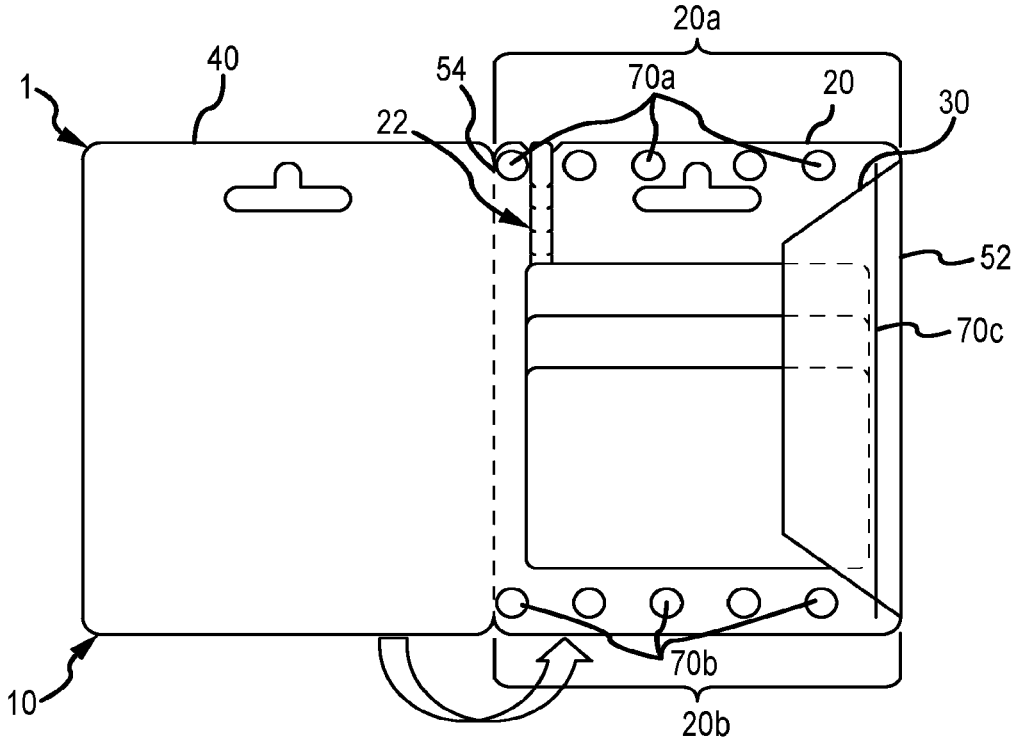
FIG. 12 schematically illustrates how a side panel of the carrier of the embodiment of FIG. 1 folds over and non-releasably connects to the center panel and folded flap of the carrier, as shown in FIG. 11.

As indicated by FIG. 12, side panel 40 may be folded along second adjoinment line 54 to extend over center panel 20 (e.g. extend over the entirety of center panel 20), cards 100*a*, 100*b*, 100*c* (e.g. extend over the entirety of cards 100*a*, 100*b*, 100*c*), and folded side flap 30 (e.g. extend over the entirety of folded side flap 30), and non-releasably, or fixedly, connected to center panel 20 and folded side flap 30 via non-releasable glue regions 70*a*, 70*b*, 70*c*. In turn, cards 100*a*, 100*b*, 100*c* may be disposed in a secure, enclosed space of the multi-card package 1, thereby reducing any potential for fraudulent access, e.g. unlawful access at a point of sale. In that regard, the glue employed for non-releasably glue regions 70*a*, 70*b*, 70*c* may be selected so that, once the non-releasable connections are made, any attempt to access the secure enclosed space along such glue regions 70*a*, 70*b*, 70*c* will result in physical damage that is readily discernable at a point of sale location prior to purchase and/or activation of the cards 100*a*, 100*b*, 100*c*.

Figure 13:
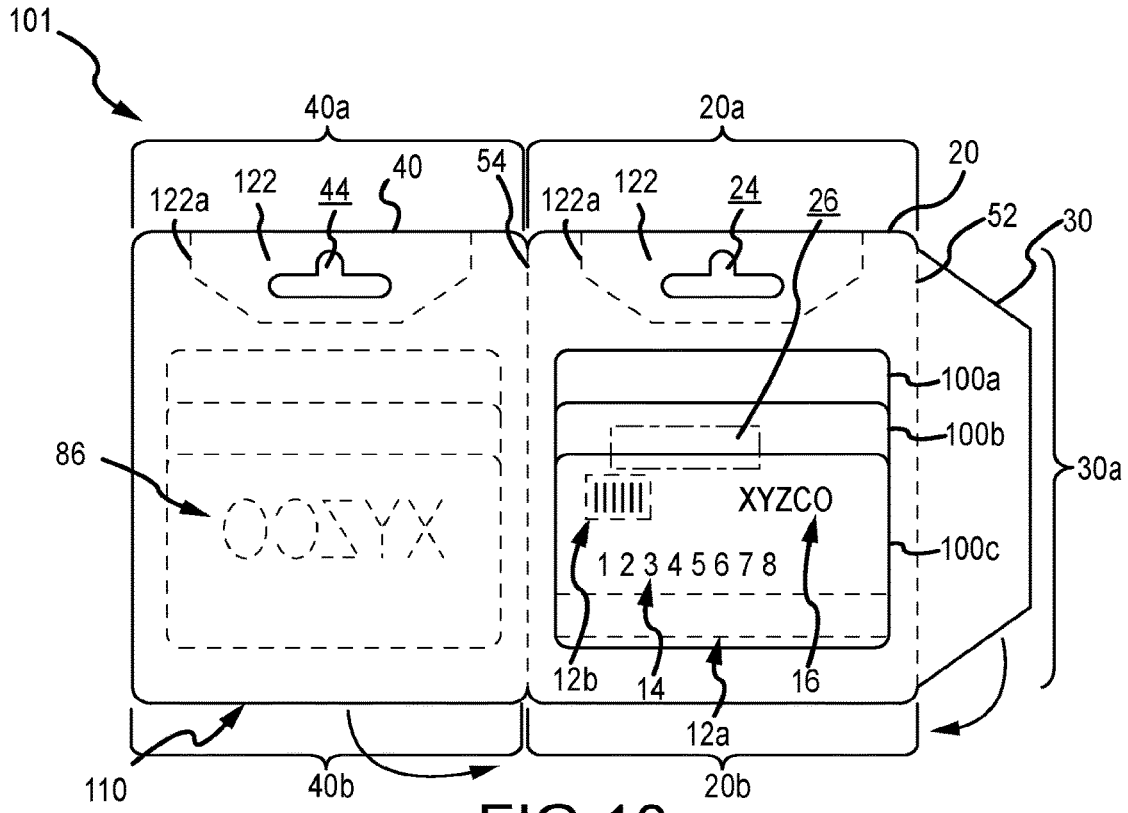
FIG. 13 illustrates another embodiment of a paper-based, multi-card package.

FIG. 13 illustrates another embodiment of a multi-card package 101 comprising a carrier 110 and a plurality of cards 100*a*, 100*b*, 100*c* (e.g. prepaid cards such as gift cards) disposed for containment within a secure, enclosed space defined by the carrier 110. As will be appreciated, the multi-card package 101 includes a number of features in common with the multi-card package 1 shown and described in relation to FIGS. 1-12 above, and in turn, such features are shown and described utilizing the same corresponding reference numerals. In that regard, the carrier 110 may comprise a center panel 20, a side flap 30 foldable over a first, or inner, side of the center panel 20 to define a seamless edge, and a side panel 40 foldable over and non-releasably securable to opposing first and second edge portions 20*a*, 20*b* of center panel 20, and to a side edge portion 30*a* of side flap 30, to define another seamless edge and the enclosed space in the finished product, as will be further described.

In contemplated embodiments, the multi-card package 101 may comprise paper-based materials. In that regard, the carrier 110 and cards 100*a*, 100*b*, 100*c* may each comprise at least about 90%, and preferably at least about 95%, by weight organic or otherwise biodegradable materials (e.g. cellulose material such as plant-based cellulose). Correspondingly, the multi-card package 101 comprises substantially no non-biodegradable polymer-based materials (e.g. less than about 5% or even 2% by weight), and otherwise comprises at least about 90%, and preferably at least about 95%, by weight organic or otherwise biodegradable materials (e.g. cellulose material such as plant-based cellulose). In turn, the multi-card package 1 provides an eco-friendly card product, while also offering superior anti-fraud advantages.

More particularly, and as illustrated in FIG. 13, carrier 10 may be of single-piece construction, wherein the center panel 20, side flap 30 and side panel 40 may be defined by a common, continuous substrate, or sheet, of a paper-based material. In turn, side flap 30 may be adjoined to center panel 20 along a first adjoinment line 52 on a first side of the center panel 20, and side panel 40 may be adjoined to center panel 20 along a second adjoinment line 54 along a second side of the center panel 20 opposite to the first side thereof. The first and second adjoinment lines 52, 54 may define corresponding fold lines, wherein upon such folding the first and second adjoinment lines 52, 54, may advantageously define opposing, secure, seamless side edges of multi-card package 1.

In the illustrated embodiment, side flap 30 extends between the first and second edge portions 20*a*, 20*b*, along first adjoinment line 52. Similarly, side panel 40 extends from first edge portion 20*a* to second edge portion 20*b* along second adjoinment line 54. In one approach, the first and second adjoinment lines 52, 54 may be defined by corresponding perforations, or depressions, in the carrier 10, thereby facilitating the folding of side flap 30 over the center panel 20 and folding of side panel 40 over the center panel 20 and folded side flap 30. As will be appreciated, upon folding side flap 30 over center panel 20 along first adjoinment line 52, and folding side panel 40 over center panel 20 along second adjoinment line 54, corresponding secure, opposing, seamless side edges may be provided by corresponding continuous lengths of the substrate comprising carrier 110 (e.g. as opposed to side edges having opposing panel edge regions adhered or otherwise adjoined along an exposed seam line), thereby yielding enhanced anti-fraud advantages, as well as advantageously facilitating the realization of a reduced width profile of a finished product (e.g. due to the elimination of side edges having opposing panel edge regions adhered or otherwise adjoined along an exposed seam line).

As shown in FIG. 13, the plurality of cards 100*a*, 100*b*, 100*c* may be disposed adjacent to the first side of center panel 20 of carrier 10 in partially overlapping relation. The cards 100*a*, 100*b*, 100*c* may be of a common rectangular configuration with a length that exceeds a width. In particular, the cards 100*a*, 100*b*, 100*c* may be sized as CR80 cards. In the illustrated embodiment, the overlapping cards 100*a*, 100*b*, 100*c* may be oriented so that the lengths thereof extend across a width dimension of the center panel 20. In some arrangements, the plurality of cards 100*a*, 100*b*, 100*c*, may comprise three cards as illustrated. In other arrangements, one, two or four or more cards may be provided. In any case, the side flap 30 may be folded over and releasably attached to at least one of the cards 100*a*, 100*b*, 100*c*, as will be further described.

In contemplated arrangements, the folded side flap 30 may overlap at least about 25% and no more than about 45% of a width of the center panel 20, and preferably between about 29% to 40% of the width of the center panel 20. Further, in some arrangements, the folded side flap 30 may overlap at least about 25% and no more than about 40% of a width of each of the plurality of cards 100*a*, 100*b*, 100*c*, and preferably between about 26% to 38% of the width of each of the plurality of cards 100*a*, 100*b*, 100*c*.

In contemplated embodiments, carrier 110 may comprise a first paperboard type having a first thickness, and the plurality of cards 100*a*, 100*b*, 100*c* may each comprise a second paperboard type having a second thickness, wherein the second thickness is at least about 50%, and preferably at least about 75%, greater than the first thickness. In some arrangements, the first paperboard type may have a first thickness within a range of about 290 micron to about 360 micron, and the second paperboard type may have a second thickness within a range of about 500 micron to about 800 micron. In one specific example, the first paperboard type may have a weight/thickness of about 260 grams per square meter/345 micron, and the second paperboard type may have weight/thickness of about 440 grams per square meter/610 micron. In some embodiments, one or both sides of the carrier 110 (e.g. at least the downward-facing, or back/outer, side thereof) and/or one or both sides of the plurality of cards 100*a*, 100*b*, 100*c* may have a coating applied thereto.

As further shown in FIG. 1, carrier 110 may further comprise a hangar aperture defined by an aperture 24 through center panel 20 and an aperture 44 through side panel 40. Apertures 24 and 44 may be of a coincidental configuration, wherein aperture 24 is larger than said aperture 44 about the peripheries thereof. As may be appreciated, aperture 44 may overlie aperture 24 to define the hangar aperture for suspending multi-card package 101 on a support hook at a point of sale location.

With further reference to FIG. 13, center panel 20 and/or side panel 40 of carrier 110 may comprise a separable portion 122, wherein after assembly of multi-card package 101 the separable portion(s) 122 is manipulatable to define an opening along an edge of first side edge portion 20*a* of the center panel 20 and/or first side edge portion 40*a* of the side panel 40 to access the enclosed space for removal of cards 100 therethrough. In the illustrated embodiment, commonly configured separable portions 122 are provided in the center panel 20 and the side panel 40, wherein such separable portions 122 are located in overlapping, coincidental, face-to-face relation in a finished product to accommodate co-manipulation and removal of the separable portions 122 together, as will be further described. The separable portion 122 of center panel 20 and/or of side panel 40 may include all or at least a portion of aperture 24 and aperture 44, respectively. In the illustrated embodiment, the separable portions 122 of center panel 20 and side panel 40 extend about the entirety of aperture 24 and aperture 44, respectively. As may be appreciated, in the event of undesired tampering with the separable portion 122 of center panel 20 and/or side panel 40, aperture 24 and/or aperture 44, respectively, may be visibly and/or functionally damaged, thereby advantageously impeding suspension of multi-card package 101 on a support hook and/or otherwise facilitating detection of such tampering before sale by service personnel at a point of sale location.

As shown, the separable portion 122 of center panel 20 may extend inward from an edge of the first side edge portion 20*a* toward the second side edge portion 20*b* thereof. Similarly, the separable portion 122 of side panel 40 may extend from an edge of a first side edge portion 40*a* of side panel 40 toward a second side edge portion 40*b* thereof. In the illustrated embodiment, separable portions 122 of center panel 20 and side panel 40 may be defined by a corresponding plurality of perforations 122*a* that successively extend from a first end located at the edge of first side edge portions 20*a* and 40*a*, respectively, to a second end, located at the same edge of first side edge portions 20*a* and 40*a*, respectively, in spaced relation to the first end thereof. In the illustrated embodiment, each plurality of perforations 122*a* may define a plurality of linear portions to facilitate manufacture and operability (e.g. five linear portions as shown), wherein adjacent ones of the linear portions may define an included angle therebetween of at least about 90 degrees to further facilitate separation of the separable portions 122. Further, the linear portions at each end of each plurality of perforations 122*a* may extend inward substantially perpendicular from the edge of first side edge portions 20*a* or 40*a*, as the case may be.

With further reference to FIG. 1, center panel 20 may optionally include an aperture 26 (shown in phantom lines) located so that a bottom one of the plurality of cards 100*a*, 100*b*, 100*c* overlaps the aperture 26. In turn, the bottom card 100*a* may be provided with account associable indicia on a downward-facing, or back, side thereof that is located in a fixed location relative to and viewable through the aperture 26 from a second, or outer, side of the center panel 20, i.e. viewable before the multi-card package is accessed for removal of the cards 100*a*, 100*b*, 100*c*, as will be further described.

As shown by exemplary card 100*c* in FIG. 13, the plurality of cards 100*a*, 100*b*, 100*c* may each include machine-readable account indicia indicative of an account corresponding with the given card and employable in transactional use of the card, e.g. in the form of an encoded magnetic stripe 12*a* (shown in phantom lines) and/or bar code 12*b* (shown in phantom lines) disposed on a downward-facing, or back, side of the card and/or on an upward-facing, or front, side of the card. Further, human-readable account indicia 14 may be provided on each of the cards 100*a*, 100*b*, 100*c*, e.g. printed and/or embossed human-readable characters on the front and/or back sides thereof. Additionally, printing 16 may be provided on the front and/or back sides of the cards 100*a*, 100*b*, 100*c*, and may comprise a name/brand/logo of a goods/services merchant and/or issuer/processor associated with the cards 100*a*, 100*b*, 100*c*, and/or graphics selected thereby. In varying instances, cards 100*a*, 100*b*, 100*c* may comprise prepaid cards for the same merchant or for different merchants. Additionally, cards 100*a*, 110*b*, 100*c* may have corresponding activatable accounts having the same prepaid value or different prepaid values. Further, cards 100*a*, 100*b*, 100*c* may be provided with additional card features, e.g. signature blocks, and scratch-off panel regions with underlying PINs (i.e. personal identification numbers for the corresponding card account).

With further reference to FIG. 13, printing 86 (shown in phantom lines) may be provided on outer-facing sides of the side panel 40 and/or center panel 20, and may comprise instructions for card activation, fraud detection inspection and/or accessing the cards 100*a*, 100*b*, 100*c*, and/or a name/brand/logo of a goods/services merchant and/or issuer/processor associated with the cards 100*a*, 100*b*, 100*c*, and/or graphics selected thereby. In one approach, the printing 86 may include a printed image of multiple cards presented in overlapping to replicate the cards 100*a*, 100*b*, 100*c* enclosed within the multi-card package 101, with the top replicated card including a name/brand/logo associated with the enclosed cards.

Figure 14:
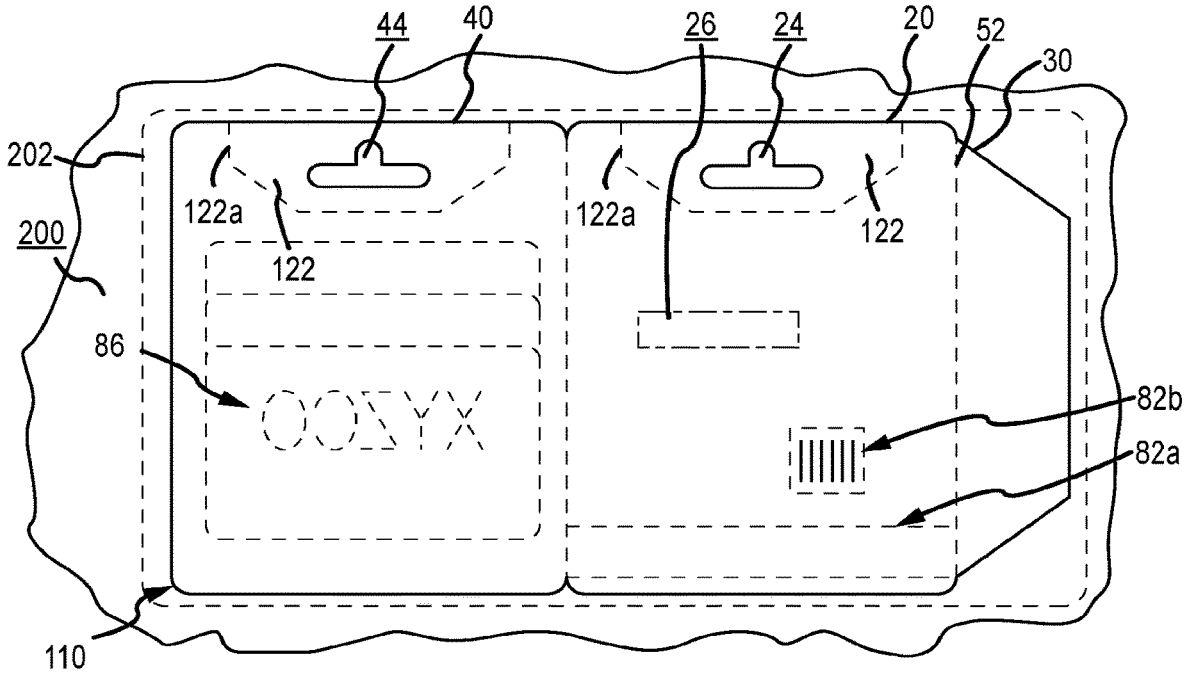
FIG. 14 illustrates a carrier of the embodiment of FIG. 13.

Reference is now made to FIGS. 14-25 which illustrate additional features of the multi-card package 101 and a method embodiment for the manufacture thereof. As shown in FIG. 14, an outer-facing, second side of the center panel 20 may be provided with machine-readable activation indicia corresponding with the plurality of cards 100*a*, 100*b*, and 100*c* and readable to activate the accounts associated with each of the cards 100*a*, 100*b*, and 100*c*. For example, the machine-readable activation indicia may comprise an encoded magnetic stripe 82*a* (shown in phantom lines) and/or bar code 82*b* (shown in phantom lines) that may be read at a POS location to effect activation of all of the accounts corresponding with cards 100*a*, 100*b*, 100*c*.

As further illustrated in FIG. 14, a single piece carrier 110 may be provided for separation from a paperboard sheet 200 via an automated operation (e.g. via an automated die cut or punch operation) to include the interconnected center panel 20, side flap 30 and side panel 40, as described above. Prior to or after such separation, the first and second adjoinment lines 52, 54 may be defined by an automated operation (e.g. an automated perforation operation), separable portion 122 may be defined by an automated operation (e.g. an automated slit formation operation), apertures 24, 44 and optional aperture 26 may be defined by an automated operation (e.g. via an automated die cut or punch operation), printing 86 may be defined on one or both sides of carrier 110 by an automated operation (e.g. via one or more of an automated silk-screening, lithographic, Gauvre roll, ink-jet and/or other printing operation), and machine readable activation indicia 82*a*, 82*b* may be provided by an automated operation (e.g. via an automated operation in which a back surface of magnetic stripe 82*a* is adhered to the carrier 110 and thereafter encoded and/or in which bar code 82*b* is printed on the carrier 110).

In one approach, a plurality of carriers 110 may be separated from different corresponding regions 202 of the paperboard sheet 200 in an automated operation, and prior to such separation, one or more of the additional automated operations noted above may be completed in relation to each of the corresponding regions 202 of the paperboard sheet 200. For example, the plurality of regions 202 may be arranged in rows and columns across the paperboard sheet 200, wherein corresponding carriers 110 and described features thereof are commonly oriented in each of the plurality of regions 202.

In conjunction with such approach, a length of magnetic tape may be adhered to paperboard sheet 200 to extend across a number of regions 202 to define the magnetic stripe 82*a* of a corresponding number of carriers 110 thereafter separated from the paperboard sheet 200. In turn, after separation of a given carrier 110 from paperboard sheet 200, the corresponding magnetic stripe 82*a* may be encoded with activation data associable with the accounts corresponding with cards 100*a*, 100*b*, 100*c* to be provided therewith, typically prior to positioning of the cards 100*a*, 100*b*, 100*c* relative to carrier 110. Relatedly, if a bar code 82*b* is employed it is normally printed on a given carrier 110 after separation from paperboard sheet 200 to provide activation data associable with the accounts corresponding with cards 100*a*, 100*b*, 100*c* to be provided therewith, typically prior to positioning of the cards 100*a*, 100*b*, 100*c* relative to carrier 110.

Similarly, cards 100*a*, 100*b*, 100*c*, and additional cards thereto, may be separated, or singulated, from another paperboard sheet in an automated operation. In that regard, a length of magnetic tape may be adhered to the paperboard sheet to extend across a number of regions to define the magnetic stripe 12*a* of a corresponding number of cards thereafter separated from the paperboard sheet. In turn, after separation of cards 100*a*, 100*b*, 100*c* from the paperboard sheet, the corresponding magnetic stripes 12*a* may be encoded with corresponding account-specific data prior to positioning of the cards 100*a*, 100*b*, 100*c* relative to carrier 110. Relatedly, if bar codes 12*b* are employed on cards 100*a*, 100*b*, 100*c*, a bar code 12*b* may be printed on each given card after separation from the paperboard sheet to provide corresponding account-specific data corresponding with the card, typically prior to positioning of cards 100*a*, 100*b*, 100*c* relative to carrier 10.

Figure 15:
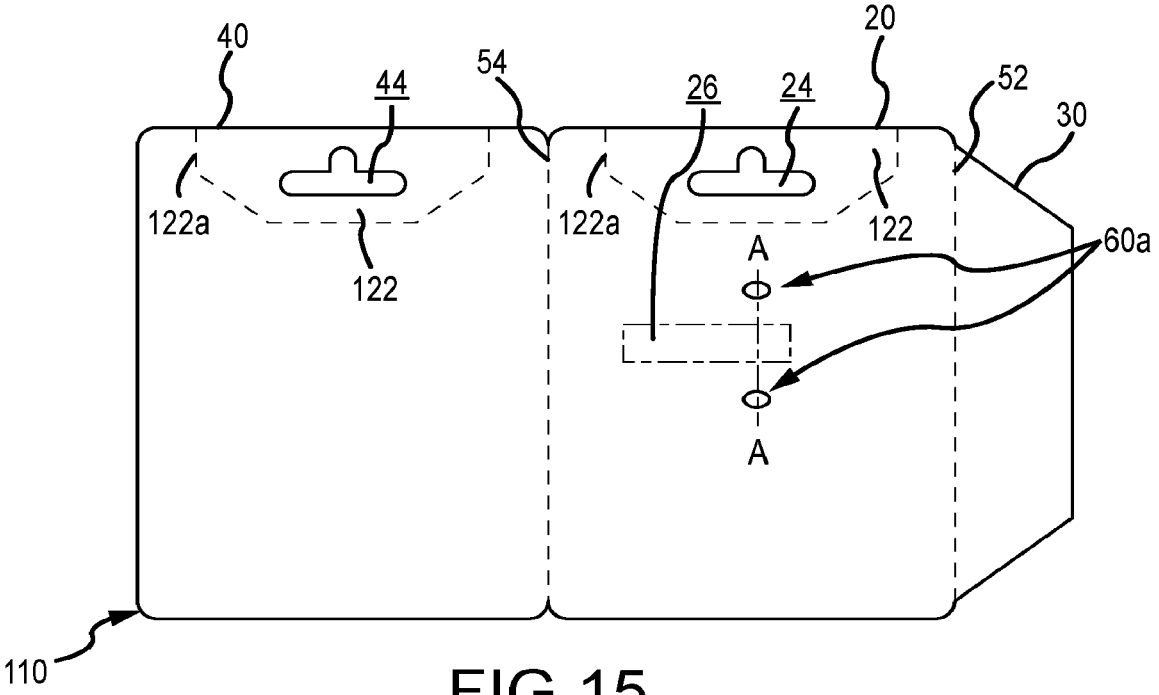
FIGS. 15-20 illustrate the carrier of the embodiment of FIG. 13, and the successive disposition of glue regions and releasable attachment of cards of the embodiment of FIG. 13.

Reference is now made to FIGS. 15-20 which illustrate steps for sequential attachment of cards 100*a*, 100*b* and 100*c*. As shown in FIG. 15, at least one or a plurality of first peelable glue regions 60*a* (e.g. glue dots) may be disposed on the first side of center panel 20, offset from the separable portion 122 and optional aperture 26. In the illustrated embodiment, two first peelable glue regions 60*a* may be located in offset relation along an axis AA that extends in a direction substantially parallel to the first and second adjoinment lines 52, 54.

Figure 16:
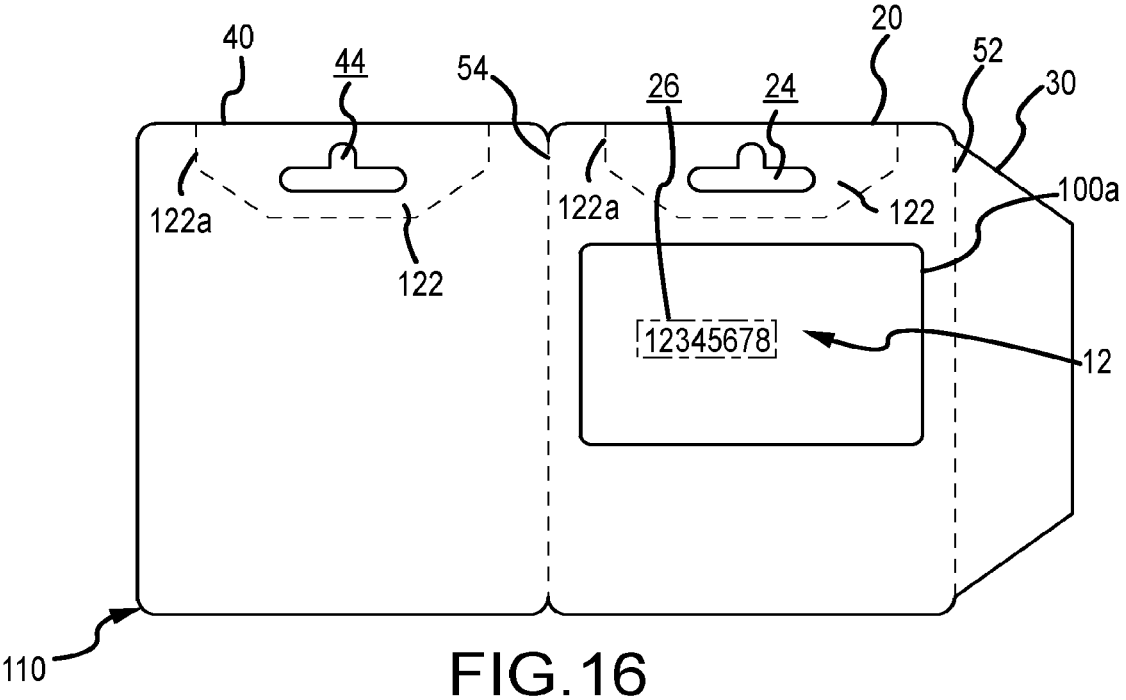

FIG. 16 illustrates releasable attachment of card 100*a* to the first side of center panel 20 via the first peelable glue regions line 60*a*. As shown in phantom lines, card 100*a* may be attached so that account indicia 12 disposed on the down-facing, or back, side of card 100*a* is visible through the optional aperture 26 from a second side of the center panel 20.

Figure 17:
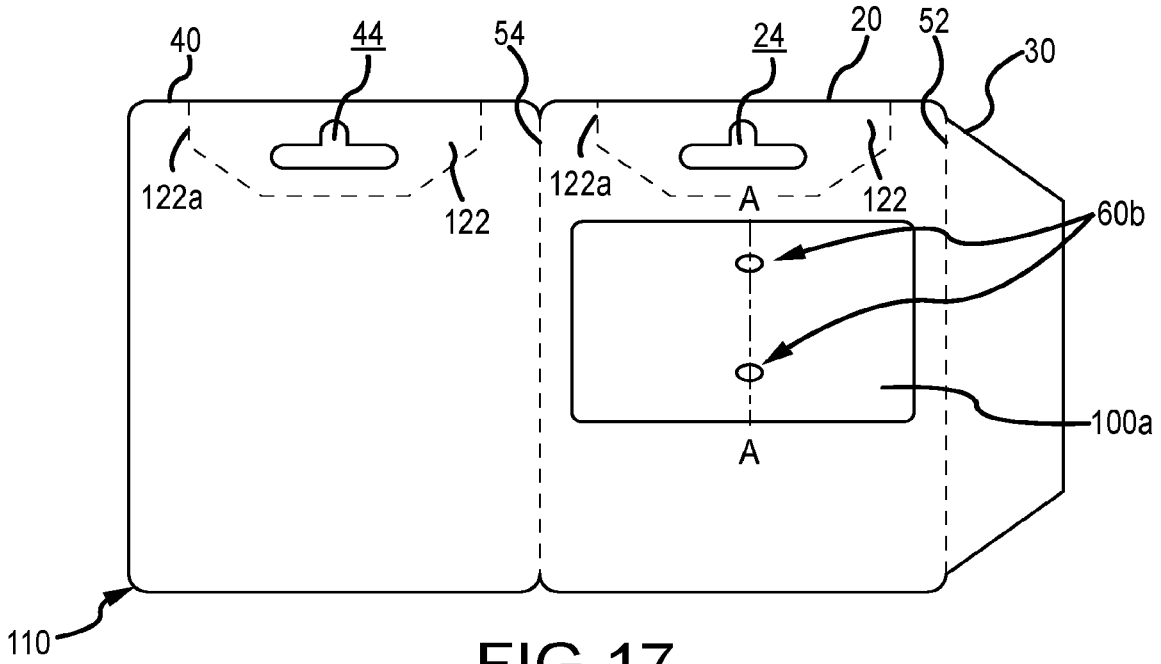

As shown in FIG. 17, at least one or a plurality of second peelable glue regions 60*b* (e.g. glue dots) may be disposed on the upward-facing, or front, side of card 100*a*. In the illustrated embodiment, two second peelable glue regions 60*b* may be located in offset relation along axis AA that extends in a direction substantially parallel to the first and second adjoinment lines 52, 54, thereby facilitating automated operations for disposing the first and second peelable glue regions 60*a*, 60*b*.

Figure 18:
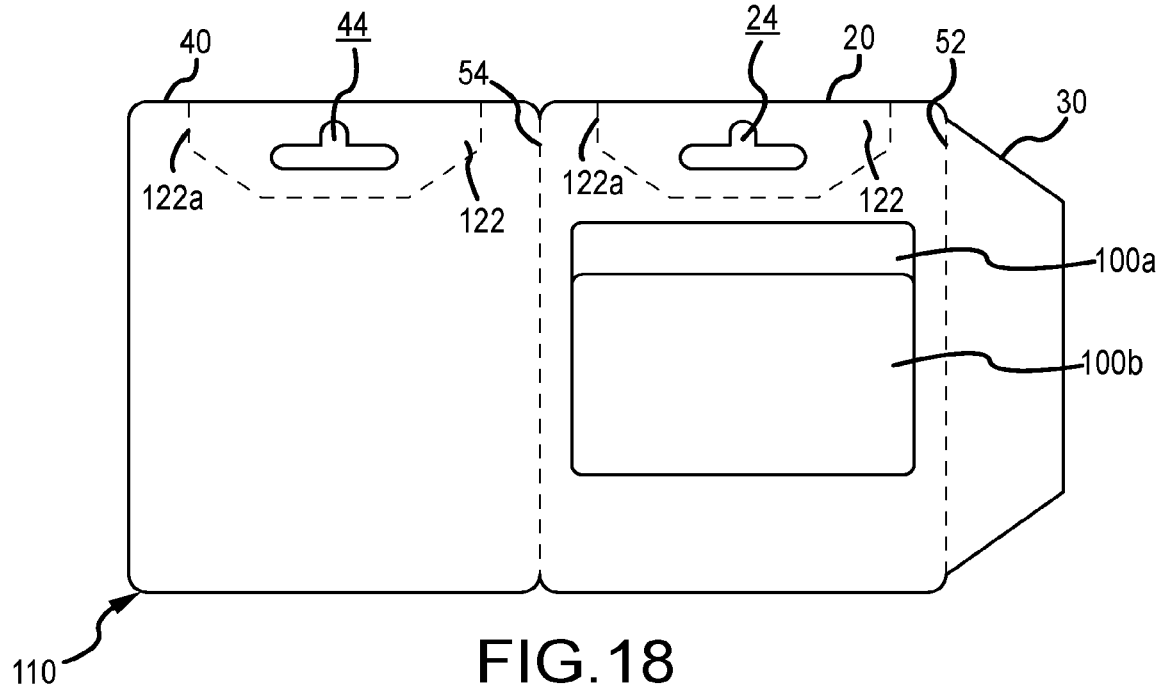

FIG. 18 illustrates releasable attachment of card 100*b* to the upward-facing, or front, side of card 100*a* via the second peelable glue regions 60*b*. As shown, card 100*b* may partially overlap card 100*a* with the second peelable glue regions 60*b* disposed between the overlapping portions of cards 100*a* and 100*b*.

Figure 19:
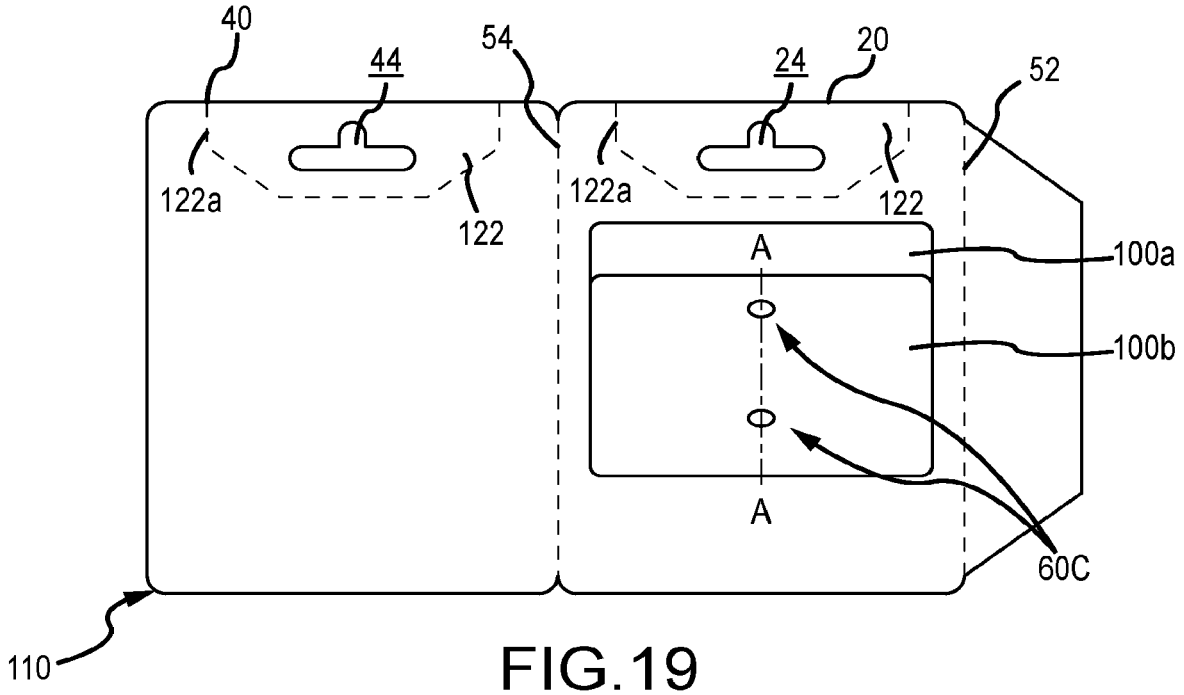

As shown in FIG. 19, at least one or a plurality of third peelable glue regions 60*c* (e.g. glue dots) may be disposed on the upward-facing, or front, side of card 100*b*. In the illustrated embodiment, two third peelable glue regions 60*c* may be located in offset relation along axis AA that extends in a direction substantially parallel to the first and second adjoinment lines 52, 54, thereby facilitating automated operations for disposing the first, second and third peelable glue regions 60*a*, 60*b*, 60*c*.

Figure 20:
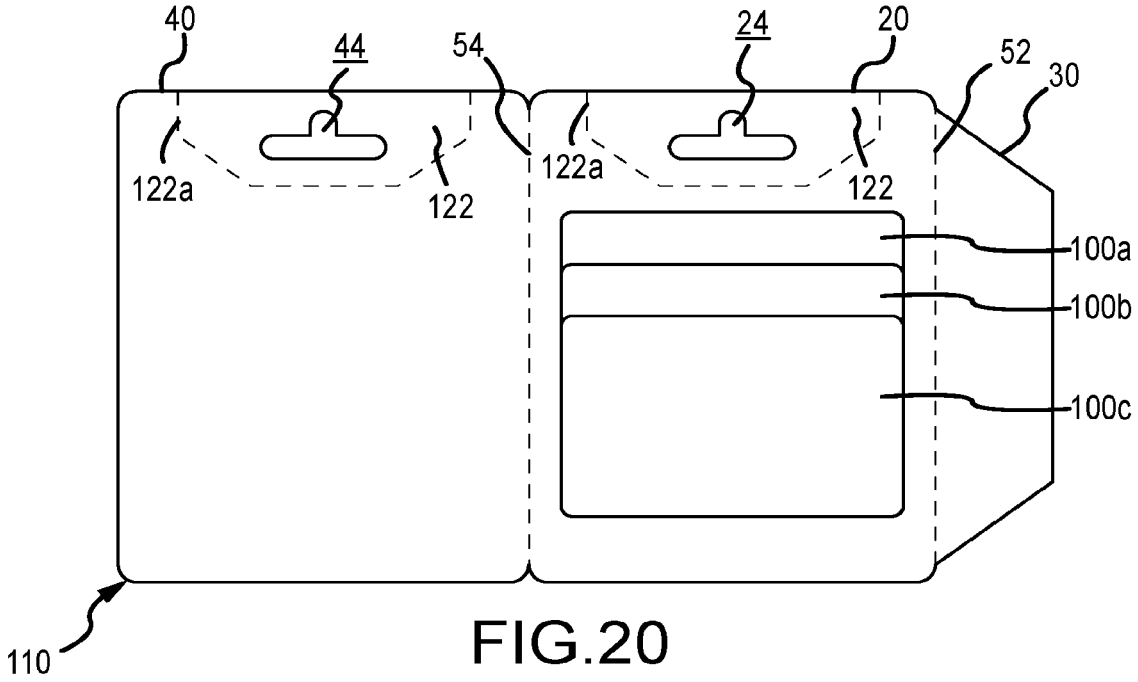

FIG. 20 illustrates releasable attachment of card 100*c* to the upward-facing, or front, side of card 100*b* via the third peelable glue regions 60*c*. As shown, card 100*c* may partially overlap card 100*b* with the third peelable glue regions 60*c* disposed between the overlapping portions of cards 100*b* and 100*c*. Further, each of the cards 100*a*, 100*b*, and 100*c* may be located in offset relation to the separable portion 122 of center panel 20.

Figure 21:
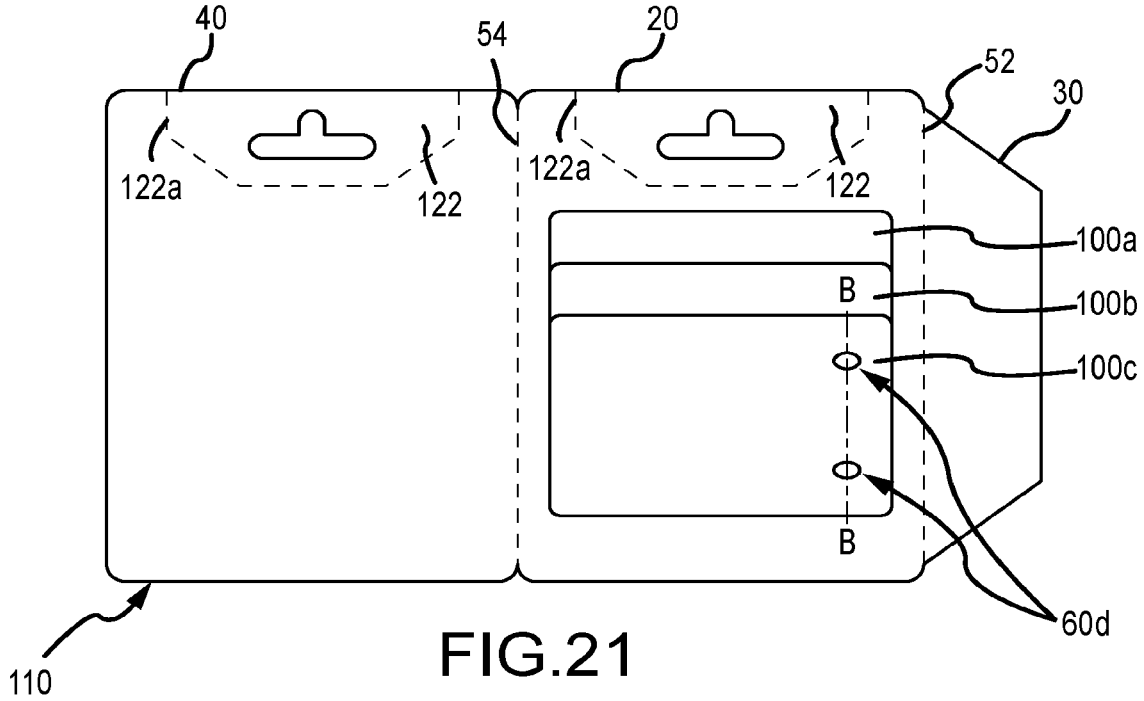
FIG. 21 illustrates the carrier of the embodiment of FIG. 13, and the disposition of at least one additional glue region to at least one of the cards of the embodiment of FIG. 13.

Reference is now made to FIGS. 21-24 which illustrate fold-over positioning of and releasable attachment of side flap 30 relative to cards 100*a*, 100*b*, 100*c*, and non-releasable attachment of side panel 40 to center panel 20 and folded side flap 30. As shown in FIG. 21, at least one or a plurality of fourth peelable glue regions 60*d* may be disposed on the top side of card 100*c*. In the illustrated embodiment, two fourth peelable glue regions 60*c* may be located in offset relation along axis BB that extends in a direction substantially parallel to the first and second adjoinment lines 52, 54, thereby facilitating automated operations for disposing the first, second, third and fourth peelable glue regions 60*a*, 60*b*, 60*c*, 60*d*. As shown in FIG. 21, axis BB may be located a distance from first adjoinment line 52 that is less than a width of the side flap 30 to be folded over the center panel 20.

Figure 22:
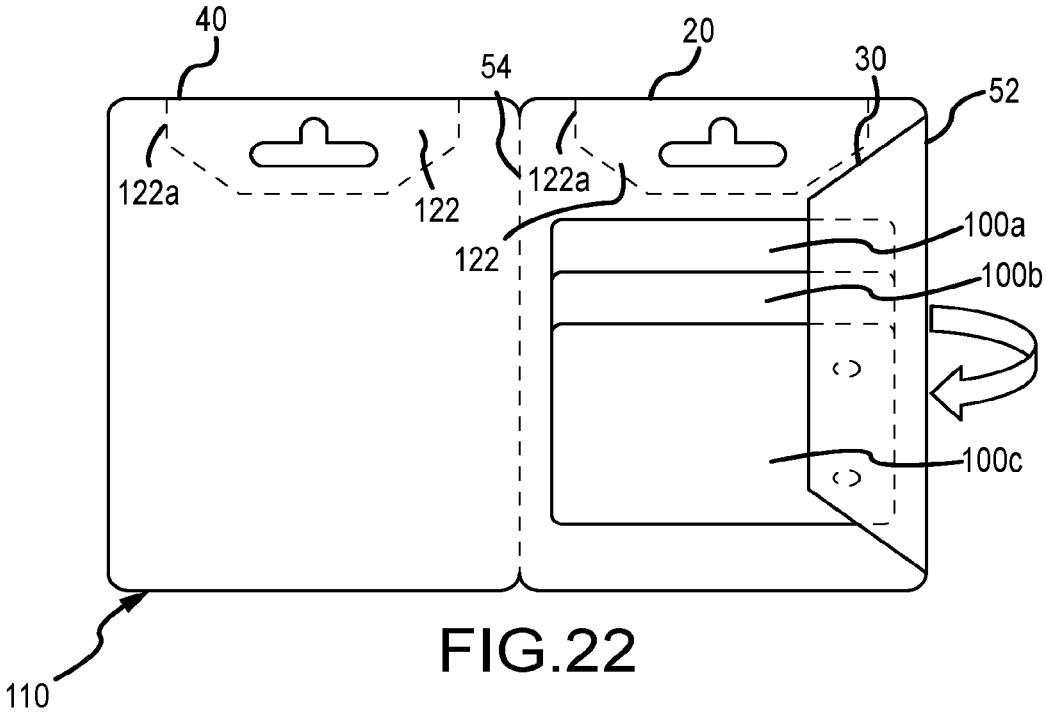
FIG. 22 illustrates a side flap of the carrier of the embodiment of FIG. 13, as folded over a center panel thereof and releasably attached to the additional glue regions shown in FIG. 21.

More particularly, and as shown in FIG. 22, side flap 30 may be folded along first adjoinment line 52, over portions of center panel 20 and cards 100*a*, 100*b*, 100*c*, and releasably attached to cards 100*a*, 100*b*, 100*c* via the fourth peelable glue regions 60*d*. As may be appreciated, the fold at first adjoinment line 52 defines a secure, seamless side edge of the multi-card package 1.

Figure 23:
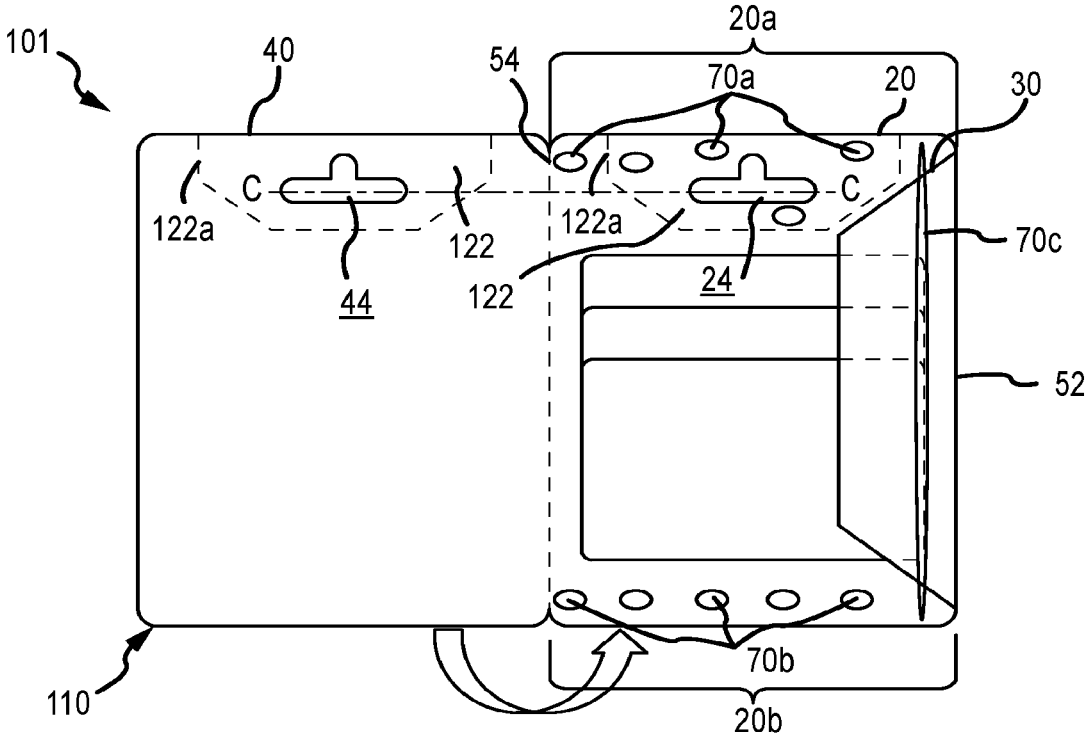
FIG. 23 illustrates the disposition of glue regions on the center panel and folded side flap of the carrier of the embodiment of FIG. 13, and how a side panel of the carrier of the embodiment of FIG. 13 folds over and non-releasably connects to the center panel and folded flap of the carrier.

In turn, and as illustrated in FIG. 23, non-releasable glue regions 70*a*, 70*b* and 70*c* may be disposed on center panel 20 and folded side flap 30. More particularly, a plurality of non-releasable glue regions 70*a* (e.g. glue dots) may disposed on the first side of center panel 20 along the first side edge portion 20*a*, a plurality of non-releasable glue regions 70*b* (e.g. glue dots) may be disposed on the first side of center panel 20 along the second side edge portion 20*b*, and a non-releasable glue region 70*c* in the form of a continuous glue line may be disposed on the folded side flap 30, offset from the side edge defined by first adjoinment line 52 (e.g. parallel thereto) and having end portions that extend over adjacent portions of center panel 20 on the first side thereof. As shown, one or more glue regions 70*a* may be disposed on opposing sides of aperture 24, e.g. on opposing sides of an axis CC that extends through apertures 24 and 44, substantially parallel to the edges of first side portion 20*a* and second side edge portion 40*a*. In turn, visible evidence of any potential tampering is enhanced. Again, the non-releasable glue regions 70*a*, 70*b*, 70*c* may be disposed in automated operations.

Figure 24:
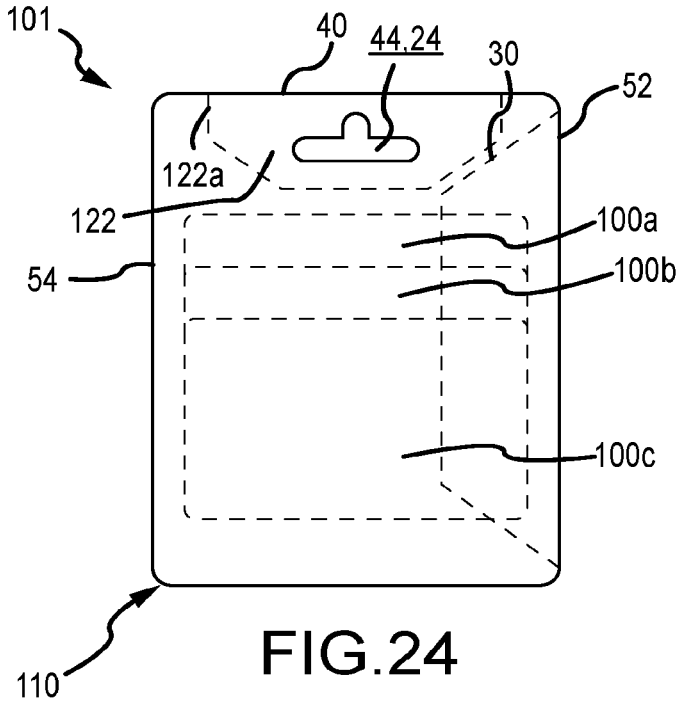
FIG. 24 illustrates a back view of the embodiment of FIG. 13, as completed after folding and non-releasable connection of the side panel to the center panel and folded flap of the carrier.
Figure 25:
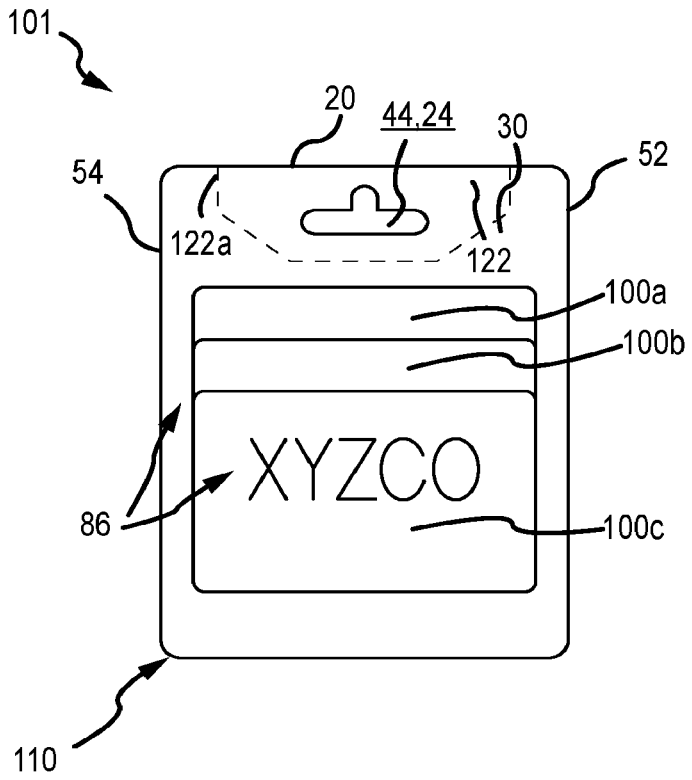
FIG. 25 illustrates a front view of the embodiment of FIG. 13, as completed after folding and non-releasable connection of the side panel to the center panel and folded flap of the carrier, wherein an optional printed image of multiple cards is presented on a front side of the carrier to replicate the positioning of the multiple cards enclosed within the completed embodiment.

As shown by FIGS. 23 and 24, side panel 40 may be folded along second adjoinment line 54 to extend over center panel 20 (e.g. extend over the entirety of center panel 20), cards 100*a*, 100*b*, 100*c* (e.g. extend over the entirety of cards 100*a*, 100*b*, 100*c*), and folded side flap 30 (e.g. extend over the entirety of folded side flap 30), and non-releasably, or fixedly, connected to center panel 20 (e.g. fixedly connected to first and second side edge portions 20*a*, 20*b*) and folded side flap 30 via non-releasable glue regions 70*a*, 70*b*, 70*c*, to complete assembly of the multi-card package 101. In turn, and as shown in FIG. 24, cards 100*a*, 100*b*, 100*c* may be disposed in a secure, enclosed space of the multi-card package 101, thereby reducing any potential for fraudulent access, e.g. unlawful access at a point of sale. In that regard, the glue employed for non-releasably glue regions 70*a*, 70*b*, 70*c* may be selected so that, once the non-releasable connections are made, any attempt to access the secure enclosed space along such glue regions 70*a*, 70*b*, 70*c* will result in physical damage that is readily discernable at a point of sale location prior to purchase and/or activation of the cards 100*a*, 100*b*, 100*c*. As shown in FIG. 25, the printing 86 on the outer side of side panel 86 may include a printed image of multiple cards presented in overlapping relation to replicate the cards 100*a*, 100*b*, 100*c* enclosed within the multi-card package 101, with the top replicated card including a name/brand/logo associated with the enclosed cards.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain known modes of practicing the invention and to enable others skilled in the art to utilize the invention in such or other embodiments and with various modifications required by the particular application(s) or use(s) of the present invention. It is intended that the appended claims be construed to include alternative embodiments to the extent permitted by the prior art.

The invention claimed is:

1. A multi-card package, comprising:

a plurality of cards, each being paper-based and having machine-readable indicia indicative of an account associated therewith; and, a paper-based carrier, including:

a center panel including a first separable portion defined by a plurality of perforations and including a first aperture;

a side flap adjoined to the center panel along a first adjoinment line, wherein the side flap is folded over at least a portion of a first side of the center panel to define a seamless side edge; and, a side panel adjoined to the center panel along a second adjoinment line and including a second separable portion defined by a plurality of perforations corresponding to the plurality of perforations in the center panel and including a second aperture corresponding to said first aperture, wherein:

said side panel is folded over and securely connected to opposing first and second edge portions of the first side of the center panel and a side edge portion of the folded side flap to define a secure, enclosed space within which the plurality of cards are disposed;

said first separable portion in said center panel and said second separable portion in said side panel are overlapping and manipulatable together for separation from the multi-card package to define an opening to access said enclosed space for removal of the plurality of cards therethrough; and the corresponding first and second apertures combinatively define a hanger aperture of the multi-card package.

2. A multi-card package as recited in claim 1, wherein the multi-card package comprises at least about 90% by weight organic and biodegradable materials.

3. A multi-card package as recited in claim 1, wherein said side flap is folded over at least a portion of and releasably attached to at least one of said plurality of cards.

4. A multi-card package as recited in claim 3, wherein said side flap is folded over at least a portion of each of said plurality of cards.

5. A multi-card package as recited in claim 4, wherein adjacent ones of said plurality of cards are disposed in partially overlapping relation.

6. A multi-card package as recited in claim 5, wherein said side flap is releasably attached to each of said plurality of cards by a continuous, peelable glue line disposed on and extending across portions of each of said plurality of cards.

7. A multi-card package as recited in claim 5, wherein at least a bottom card of said plurality of cards is releasably attached to the first side of the center panel.

8. A multi-card package as recited in claim 7, wherein overlapping portions of said adjacent ones of said plurality of cards are releasably attached to one another.

9. A multi-card package as recited in claim 8, wherein said bottom card is releasably attached to the first side of the center panel by at least one peelable glue region disposed on the first side of the center panel, wherein the overlapping portions of said adjacent ones of the plurality of cards are releasably attached by at least one a corresponding additional, peelable glue region disposed on an overlapped portion of a corresponding one of the plurality of cards.

10. A multi-card package as recited in claim 8, wherein said side panel is securely connected to said top and bottom edge portions of the first side of the center panel and said side edge portion of the folded side flap by non-releasable glue regions.

11. A multi-card package as recited in claim 7 -wherein said bottom card of said plurality of cards is releasably attached to the first side of the center panel in a predetermined position so that account associable indicia provided on said bottom card is viewable through the aperture from a second side of the center panel.

12. A multi-card package as recited in claim 11, said account associable indicia comprising a series of human-readable characters.

13. A multi-card package as recited in claim 1, wherein said first separable portion extends inward from one of said first and second edges of the center panel toward the other one of said first and second edges of the center panel.

14. A multi-card package as recited in claim 13, wherein said first separable portion comprises at least one of the following:

a tear strip defined by at least one of the following:

a tear string having a graspable end located at said one of said top and bottom edges of the center panel; and, a pair of adjacent perforation lines defining a graspable pull tab at said one of said top and bottom edges of the center panel; and, a perforation line.

15. A multi-card package as recited in claim 13, wherein said first separable portion extends from said one of said top and bottom edges of the center panel to an end location overlapped by at least one of the plurality of cards, and wherein said first separable portion is partially overlapped by each of said plurality of cards.

16. A multi-card package as recited in claim 1, wherein said carrier is of a first rectangular configuration with a first length greater than a first width, and wherein said plurality of cards are of a common, second rectangular configuration with a second length greater than a second width, wherein the plurality of cards are disposed lengthwise across a portion of the first width of the carrier within said secure, enclosed space.

17. A multi-card package as recited in claim 16, wherein said first and second edge portions of the first side of the center panel extend along top and bottom edge portions of the carrier, respectively, and wherein said edge portion of the folded side flap extends along a first side edge portion of the carrier between said top and bottom edge portions thereof.

18. A multi-card package as recited in claim 17, wherein said folded side flap overlaps at least about 25% of said second width of each of said plurality of cards.

19. A multi-card package as recited in claim 1, wherein said carrier is of a single piece construction and comprises a first paperboard type having a first thickness, wherein said plurality of cards each comprise a second paperboard type having a second thickness, and wherein said second thickness is at least 75% greater than said first thickness.

20. A method for producing a paper-based multi-card package, comprising:

separating a single-piece carrier from a first sheet of paperboard, wherein the carrier includes:

a center panel including a first separable portion defined by a plurality of perforations and including a first aperture;

a side flap adjoined to the center panel along a first adjoinment line; and a side panel adjoined to the center panel along a second adjoinment line and including a second separable portion defined by a plurality of perforations corresponding to the plurality of perforations in the center panel and including a second aperture for correspondence with said first aperture; and wherein said first separable portion in said center panel and said second separable portion in said side panel are overlapping in said constructed carrier and manipulatable together for separation from the multi-card package to define an opening to access said enclosed space for removal of the plurality of cards therethrough; and the corresponding first and second apertures combinatively define a hanger aperture of the multi-card package;

positioning a plurality of cards adjacent to a first side of the center panel, each of the plurality of cards being paper-based and having indicia indicative of a corresponding account;

first folding the side flap over at least a portion of the first side of the center flap to define a seamless side edge, and second folding the side panel over and securing the side panel to opposing first and second side edge portion of the first side of the center panel and a side edge portion of the folded side flap to define a secure, enclosed space within which the plurality of cards are disposed.

21. A method as recited in claim 20, wherein the multi-card package comprises at least about 90% by weight organic and biodegradable materials.

22. A method as recited in claim 20, wherein prior to said positioning the method further comprises:

singulating said plurality of cards from a second paperboard sheet.

23. A method as recited in claim 22, wherein said second paperboard sheet has a thickness that is at least 75% greater than a thickness of the first paperboard sheet.

24. A method as recited in claim 22, wherein after said singulating the method further comprises:

providing said indicia in the form of machine-readable indicia to each of said plurality of cards by at least one of the following:

encoding a magnetic stripe disposed on the given card; and, applying a bar code to the given card.

25. A method as recited in claim 20, wherein said first folding comprises:

folding the side flap over at least a portion of and releasably attaching the side flap to at least one of the plurality of cards.

26. A method as recited in claim 20, wherein said first folding comprises:

folding the side flap over at least a portion of and releasably attaching the side flap to each of the plurality of cards.

27. A method as recited in claim 20, wherein the positioning comprises:

first disposing a first peelable glue region to the first side of the center panel;

first releasably attaching a first one of the plurality of cards to the first peelable glue region in a predetermined position on the first side of the center panel;

second disposing a second peelable glue region to an upward-facing side of the first one of the plurality of cards; and, second releasably attaching a second one of the plurality of cards to the second peelable glue region in partially overlapped relation to the first one of the plurality of cards.

28. A method as recited in claim 27, wherein the positioning further comprises:

third disposing a third peelable glue region to an upward-facing side of the second one of the plurality of cards; and, third releasably attaching a third one of the plurality of cards to the third peelable glue region in partially overlapped relation to the second one of the plurality of cards.

29. A method as recited in claim 27, wherein said first peelable glue region and second peelable glue region are defined by glue lines disposed in substantially parallel relation across corresponding lengths of the first and second ones of the plurality of cards.

30. A method as recited in claim 27, wherein after said positioning and prior to said first folding the method further comprises:

disposing an additional peelable glue region to an upward-facing side of at least one of said plurality of cards, wherein said side flap is releasably attached to said at least one of the plurality of cards upon said first folding.

31. A method as recited in claim 30, wherein said additional peelable glue region is defined by an additional glue line continuously disposed on an upward-facing side of at least said first and second ones of the plurality of cards.

32. A method as recited in claim 20, wherein after said positioning and first folding, and prior to said second folding, said method further comprises:

disposing non-peelable glue regions on said first and second side edge regions of said first side of the center panel and said side edge region of the side flap, wherein said side panel is non-releasably connected to the center panel upon said second folding.

33. A method as recited in claim 20, wherein said carrier is one of a plurality of carriers separated from a corresponding plurality of regions of said first paperboard sheet, and wherein prior to said separating the method further comprises:

defining said first and second adjoinment lines in the corresponding region of the plurality of regions of said first paperboard sheet.

34. A method as recited in claim 33, wherein said center panel of the carrier comprises an aperture, and wherein prior to the separating the method further comprises:

defining said first and second apertures in the corresponding region of the plurality of regions of said first paperboard sheet.

35. A method as recited in claim 33, wherein said positioning further comprises:

releasably attaching a bottom card of the plurality of cards to the first side of the center panel in a predetermined position so that account associable indicia provided on the bottom card and associable with at least the account corresponding therewith is viewable through said aperture from a second side of the center panel.

36. A method as recited in claim 33, wherein prior to the separating the method further comprises:

defining said first and second separable portions of each of said center panel and side panel of the carrier in the corresponding region of the plurality of regions of said first paperboard sheet.

37. A method as recited in claim 34, wherein said positioning further comprises:

attachably positioning each of the plurality of cards in corresponding locations that overlap corresponding portions of the first separable portions, wherein said first separable portion extends from one of said first and second edges of the center panel toward the other one of said first and second edges of the center panel, and wherein one of said corresponding locations overlaps an end portion of the first separable portion.

* * * * *